US009752099B2

(12) United States Patent
Proctor et al.

(10) Patent No.: US 9,752,099 B2
(45) Date of Patent: Sep. 5, 2017

(54) CONJUGATED LINOLEIC ACID RICH VEGETABLE OIL PRODUCTION USING HETEROGENEOUS CATALYSIS

(71) Applicant: Board of Trustees of the University of Arkansas, Little Rock, AR (US)

(72) Inventors: Andrew Proctor, Fayetteville, OK (US); Chuan Min Ruan, Fayetteville, AR (US)

(73) Assignee: BOARD OF TRUSTEES OF THE UNIVERSITY OF ARKANSAS, Little Rock, AR (US)

( * ) Notice: Subject to any disclaimer, the term of this patent is extended or adjusted under 35 U.S.C. 154(b) by 13 days.

(21) Appl. No.: 14/960,919

(22) Filed: Dec. 7, 2015

(65) Prior Publication Data

US 2016/0160154 A1 Jun. 9, 2016

Related U.S. Application Data

(60) Provisional application No. 62/088,448, filed on Dec. 5, 2014.

(51) Int. Cl.
*C11C 3/00* (2006.01)
*C11C 3/14* (2006.01)

(52) U.S. Cl.
CPC ..... *C11C 3/14* (2013.01)

(58) Field of Classification Search
CPC ..... C11C 3/14
USPC ..... 554/126
See application file for complete search history.

(56) References Cited

U.S. PATENT DOCUMENTS 5,719,301 A * 2/1998 Sleeter ..... C11C 3/14 554/126
6,610,868 B2 8/2003 Saebo et al.
2012/0295974 A1 11/2012 Proctor et al.
2013/0245299 A1 9/2013 Geboers et al.
2014/0154393 A1 6/2014 Proctor et al.

FOREIGN PATENT DOCUMENTS

GB 1122398 A 8/1968
JP 2011190451 A 9/2011

OTHER PUBLICATIONS

Effects of Temperature and Agitation Rate on the Formation of Conjugated Linoleic Acids in Soybean Oil During Hydrogenation Process; Jung, et al.; J. Agric. Food Chem. 2001, 49, 3010-3016.

(Continued)

*Primary Examiner* — Deborah D Carr
(74) *Attorney, Agent, or Firm* — Crowe & Dunlevy, P.C.

(57) ABSTRACT

The invention is directed to CLA-rich vegetable oil production from linoleic rich oils by heterogeneous catalysis. The process produces conjugated PUFA in triglyceride form, preferably at least 20% CLA-rich, by isomerization of a non-conjugated PUFA in vegetable oils using a heterogeneous transition metal catalyst promoted by an organic acid and/or thiol-containing compound. The heterogeneous catalysis isomerization process can use steam/vacuum distillation, hydrogenation unit and/or deodorization to produce CLA-rich soy oil. After processing, any catalyst residue may be removed by filtration, beaching, deodorizing, adsorbents or centrifugation to obtain high quality, CLA-rich oils.

35 Claims, 10 Drawing Sheets

(56) References Cited

OTHER PUBLICATIONS

Norris LE, Collene AL, Asp ML, Hsu JC, Liu LF, Richardson JR, Li D, Bell D, Osei K, Jackson RD, Belury MA (2009) Comparison of dietary conjugated linoleic acid with safflower oil on body composition in obese postmenopausal women with type 2 diabetes mellitus. Am J Clin Nutr 90: 468-476.
Ip C., Chin SF, Scimeca JA, Parariza MW (1991) Mammary-cancer prevention by conjugated dienoic derivative of Inoleic acid. Cancer Res 51: 6118-6124.
Turpeinen AA, Ylonen N, von Willebrand E, Basu S, Aro A (2008) Immunological and metabolic effects of cis-9, trans-11-conjugated linoleic acid in subjects with birch pollen allergy. Brit J Nutr 100: 112-119.
Bassaganya-Riera J, Hontecillas R (2010) Dietary conjugated linoleic acid and n-3 polyunsaturated fatty acids in inflammatory bowel disease. Curr Opin Clin Nutr Metab Care13: 569-573.
Smit LA, Baylin A, Campos H (2010) Conjugated linoleic acid in adipose tissue and risk of myocardial Infarction. Am J Clin Nutr 92: 34-40.
Veth MJ, Griinari M, Pfeiffer AM, Bauman DE (2004) Effect of CLA on milk fat syntheses in dairy cows: comparison of inhibition by methyl esters and free acids, and relationships among studies. Lipids 39: 365-372.
Dilzer A, Park Y (2012) Implication of Conjugated Linoleic Acid (CLA) in Human Health. Crit Rev Food Sci Nutr 52: 488-513.
Salamon, et al., Synthetic methods for obtaining conjugated linoleic acids (CLA) by catalysis, Acta Univ. Sapientiae Alimentaria, 5 (2012) 32-51.
Larock RC, Dong XY, Chung S, Reddy CK, Ehlers LE (2001) Preparation of conjugated soybean oil and other natural oils and fatty acids by homogeneous transition metal catalysis. J Am Oil Chem Soc 78: 445-453.
Quirino RL, Larock RC (2012) Rh-based biphasic isomerization of carbon-carbon double bonds in natural oils J Am Oil Chem Soc 89: 1113-1124.
Bemas A, Kumar N, Mäki-Arvela P, Holmbom B, Salmi T, Murzin DY (2003) Isomerization of linoleic acid over supported metal catalysts. Appl Catalysis A General 10: 257-275.
Bemas A, Murzin DY (2005) Linoleic acid isomerization on Ru/Al2O3 catalyst: 1: Conjugation and hydrogenation. Chem Eng J 115: 13-22.
Pakdeechanuan P, Intarapichet KO, Fernando LN, Grün IU (2005) Effects of rhodium heterogeneous catalyst and Isomerization conditions on linoleic acid conjugation of soybean oil. J Agri Food Chem 53: 923-927.
Kreich M, Claus P (2005) Direct conversion of linoleic acid over silver catalysts in the presence of H2: An unusual way towards conjugated linoleic acids. Angew Chem Int Ed Eng 44: 7800-7804.
Bauer P, Horlacher P, Claus P (2009) Direct isomerization of linoleic acid to conjugated linoleic acids (CLAs) using gold catalysts. Chem Eng Technol 32: 2005-2010.
Philippaerts A, Goossens S, Vermandel W, Tromp M, Turner S, Geboers J, Van Tendeloo G, Jacobs PA, Sels BF (2011) Design of Ru-zeolites for hydrogen-free production of conjugated linoleic acids. Chem Sus Chem 4: 757-67.
Hydrogenation for Low Trans and High Conjugated Fatty Acids—Jang—2006—Comprehensive Reviews in Food Science and Food Safety—Wiley Online Library.
Nash AM, Mounts TL, Kwolek WF (1983) Determination of ultratrace metals in hydrogenated vegetable oils and fats. J Am Oil Chem Soc 60: 811-814.
Christie WW, Sébédio JL, Juanéda P. (2001) A practical guide to the analysis of conjugated linoleic acid. Inform 12:147-152.
Czaun M, Goeppert A, Kothandaraman J, May RB, Haiges R, Prakash GKS, Olah GA (2014) Formic acid as a hydrogen storage medium: Ruthenium-catalyzed generation of hydrogen from formic acid in emulsions. ACS Catal 4: 311-320.
Vishal P. Jain and Andrew Proctor, Photocatalytic Production and Processing of Conjugated Linoleic Acid-Rich Soy Oil—Journal of Agricultural and Food Chemistry (ACS Publications),J. Agric. Food Chem., 2006,54 (15), pp. 5590-5596.

* cited by examiner

CONJUGATED LINOLEIC ACID RICH VEGETABLE OIL PRODUCTION USING HETEROGENEOUS CATALYSIS

CROSS REFERENCE TO RELATED APPLICATIONS

This application claims the benefit of and priority to U.S. Provisional Patent Application Ser. No. 62/088,448, filed Dec. 5, 2014, which is incorporated herein by reference in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

STATEMENT REGARDING PRIOR DISCLOSURES BY THE INVENTOR OR A JOINT INVENTOR

Not Applicable.

BACKGROUND OF THE INVENTION

1. Field of the Invention

This invention relates generally to conjugated linoleic acid (CLA)-rich oil production from linoleic rich vegetable oils by heterogeneous catalysis, and more particularly to a process for producing conjugated polyunsaturated fatty acids (PUFA) in triglyceride form, preferably CLA-rich oils, by isomerization of a non-conjugated PUFA in vegetable oils using a heterogeneous transition metal catalyst promoted by an organic acid or thiol-containing compound.

2. Description of the Related Art

CLA is found naturally in dairy and beef products generally at levels of approximately 0.3-0.8% (w/w) of the fat as bovine rumen fermentation products. The current human intake of CLA is, however, approximately ten (10) times less than the 3 g/day minimum value recommended as being necessary to produce desirable physiological health effects. Obtaining the estimated optimum dietary CLA levels from natural beef and dairy sources would increase the total fat and saturated fat intake and increase the negative health risks associated with dietary animal fats.

CLA is a group of positional and geometrical isomers of linoleic acid with conjugated double bonds. The most common CLA isomers are cis-9, trans-11-octadecadienoic acid and trans-10, cis-12-octadecadienoic acid. CLA has anti-carcinogenic, anti-atherogenic, anti-diabetic and anti-obesity properties, along with the ability to increase lean body mass, to protect against immune induced body wasting disease, chronic inflammatory disease, cancer and to provide other positive health effects. CLA decreases fat and increases muscle content in the human body, reduces inflammation, shows a beneficial effect on bone formation, enhances immune functions and reduces asthma. A recent study suggests that CLA-rich soybean oil with a high percent of trans, trans CLA also exhibits beneficial health effects. Therefore, a concentrated source of dietary CLA that is low in saturated fat and cholesterol is desirable.

Soy oil is the most commonly used vegetable oil in United States, and it contains about 55% linoleic acid. Other vegetable oils high in linoleic acid include sunflower (57%), corn (55%), cottonseed (50%) and peanut (50%). Due to their technological and nutritional applications, several isomerization reactions have been developed to convert fatty acids in vegetable oils with isolated double bonds into fatty acids with conjugated double bonds. Historically, CLA fatty acid has been produced by fermentation and enzyme technology. A recent approach to CLA production includes isomerization of linoleic acid rich oil to CLA under alkaline conditions, with the aid of alkali bases or sodium methoxide dissolved in DMSO or propylene glycol, and subsequently neutralizing the alkali bases with acid. The alkaline catalytic process, however, is unable to directly produce CLA-enriched vegetable oils because of competitive hydrolysis of triacylglycerol (TAG).

CLA in vegetable oil has also been produced by converting linoleic acid to CLA using homogeneous isomerization with transition-metal catalysts, such as using iodine by homogeneous photo-catalysis. A drawback of these processes is the removal of the soluble catalyst from the CLA-rich oil before the product is suitable for human consumption.

Heterogeneous catalysis isomerization is another process utilized in CLA production, and more readily allows for catalyst separation from the CLA-rich oil. These isomerization techniques, however, have generally involved linoleic acid fatty acids or methyl linoleate isomerization in solvent-based systems.

Although a variety of methods aforementioned have been reported for producing CLA from free fatty acid and TAG forms and occasionally refined, bleached and deodorized oil, there remains a need for an improved process for producing high yields of CLA-rich vegetable oil from linoleic rich oils using heterogeneous catalysis with minimal catalyst residue.

It is further desirable to provide a process for producing conjugated PUFA in triglyceride form, preferably CLA-rich oils, by isomerization of a non-conjugated PUFA in vegetable oils using a heterogeneous transition metal catalyst promoted by an organic acid or thiol-containing compound.

It is still further desirable to provide a process of producing an enriched vegetable oil having in excess of 20% CLA using heterogeneous catalysis isomerization in the presence of a transition metal catalyst and a promoter using steam/vacuum distillation, hydrogenation and/or deodorization.

It is still yet further desirable to provide a process for producing a CLA-rich oil that requires only minimal post-processing catalyst removal.

It is still yet further desirable to provide a process for producing CLA-rich oils using heterogeneous catalysis that is an environmentally-friendly process in contrast to alkali isomerization.

It is still yet further desirable to provide a process for producing CLA-rich oils using heterogeneous catalysis that does not require any solvent or any chemical other than a catalyst and a promoter.

It is still yet further desirable to provide a process for producing CLA-rich oils from using heterogeneous catalysis in the absence of iodine and with a metal catalyst that can be easily removed and reused.

It is still yet further desirable to produce CLA-rich oils using a single step transition metal-based heterogeneous catalysis process that uses a significantly reduced amount of catalyst dose with refined, unbleached soy oil (RUBSO).

It is still yet further desirable to provide a process for producing CLA-rich oils with little to no trans-fat using transition metal-based heterogeneous catalysis with organic acids and thiol promoters to enhance the catalytic conversion rate of linoleic acid to CLA in vegetable oils.

Other advantages and features of the invention will be apparent from the following description and from the claims.

BRIEF SUMMARY OF THE INVENTION

In general, the invention relates to a process for producing conjugated linoleic acid-rich oil. The process includes heterogeneously catalyzing a linoleic acid-rich oil and a catalytic amount of a transition metal in the presence of a promoter to produce the conjugated linoleic acid-rich oil. The process can be utilized with steam/vacuum distillation, oil deodorization or hydrogenation equipment or pressure vessels. The process may also include extracting any remaining transition metal residue from the conjugated linoleic acid-rich soil, such as by filtration, bleaching, deodorization, adsorbents, centrifugation or a combination thereof. In addition, the promoter may be extracted from a steam condensate and reused during the catalysis process.

The linoleic acid-rich oil may be a triacylglyceride vegetable oil, such as soy, sunflower, corn, cottonseed or peanut oil. The transition metal may be ruthenium, rhodium, platinum, iridium, osmium, palladium or nickel, such as metal nickel, nickel sulfide (NiS), nickel formate $Ni(COO)_2$, metal nickel distributed on silica/alumina, nickel alloys with iron, aluminum, chromium and carbon loaded on silica/alumina. In addition, the nickel catalyst may be an organic amino or thiol compound self-assembly monolayer modified nickel catalyst. For example, the amount of nickel can be up to about 10% nickel, and more particularly between about 0.025% and about 1% nickel. The amount of the ruthenium may be up to about 0.064% ruthenium.

The promoter may be any organic proton donors, monosulfides, disulfides, mercaptans or mixtures thereof, such as methanol, ethanol, isopropyl alcohol, formic acid, acetic acid, benzoic acid, 2-mercaptoethanol, ethanethiol, 1,2-ethanedithiol, L-cysteine, cysteamine, thiolactic acid, mercaptosuccinic acid. For example, the process may use up to about 10% formic acid, or between about 0.05% and about 2% formic acid, in the linoleic acid-rich oil and about 85% formic acid as steam. In addition, the process may also include up to about 1% cysteine, or more particularly at a ratio of nickel to cysteine of about 1:10 or between about 0.002% and about 0.4% cysteine, in order to further increase CLA yield.

The heterogeneous catalysis can be performed at a temperature of between about 165° C. and about 250° C., under nitrogen pressure of up to about 76 psi with nitrogen bleeding, for between about 30 min and about 68 hours, to produce said conjugated linoleic acid-rich oil. For example, heterogeneous catalyzing the linoleic acid-rich oil and the amount of the transition metal in the presence of the cysteine, formic acid or a mixture thereof under bleeding nitrogen pressure between about 40 psi and about 50 psi for between about 30 min and about 6 hours at temperature of about 210° C. to produce the conjugated linoleic acid-rich oil.

DETAILED DESCRIPTION OF THE INVENTION

Figure 1:
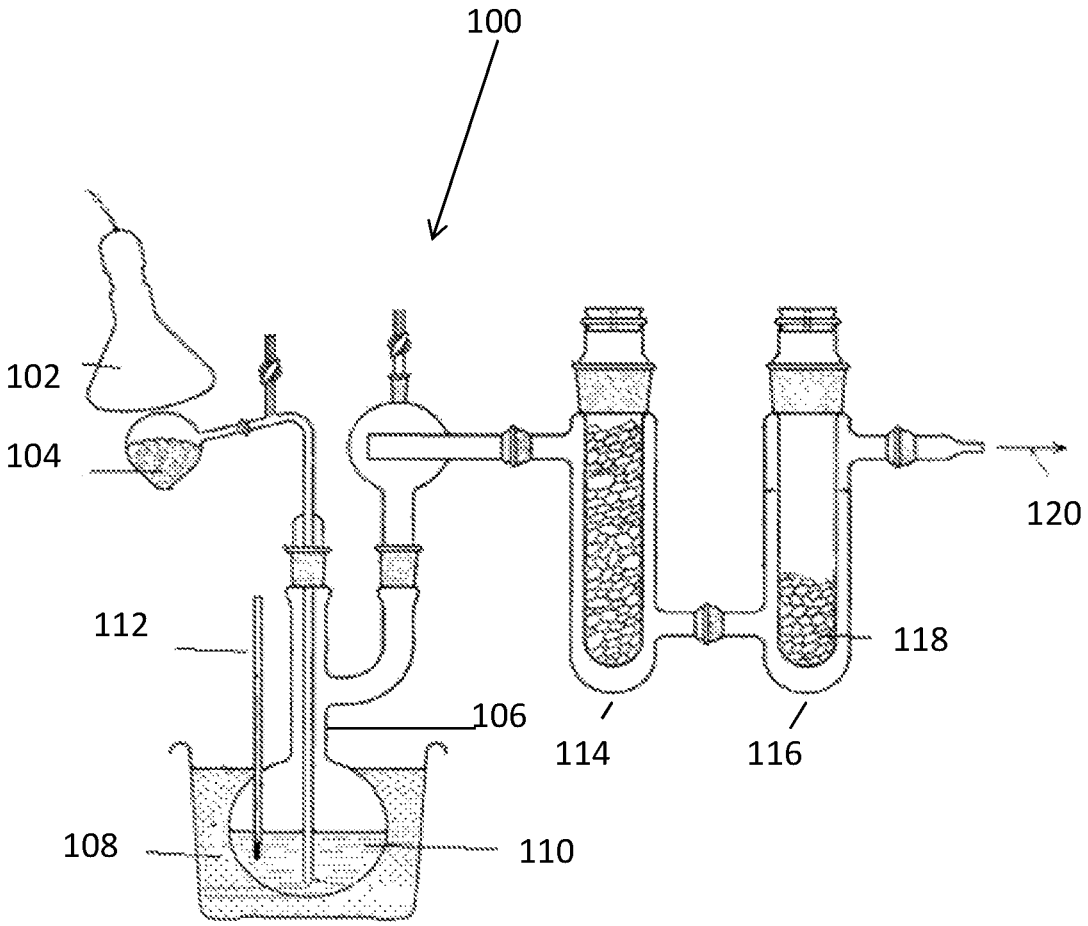
FIG. 1 is a schematic diagram of an example of a deodorization process in an aspect of the CLA-rich vegetable oil production by heterogeneous catalysis disclosed herein.

The processes and compositions discussed herein are merely illustrative of specific manners in which to make and use this invention and are not to be interpreted as limiting in scope.

While the processes and compositions have been described with a certain degree of particularity, it is to be noted that many variations and modifications may be made in the details of the sequence, components, concentrations and the arrangement of the processes and compositions without departing from the scope of this disclosure. It is understood that the invention is not limited to the embodiments set forth herein for purposes of exemplification.

The invention is generally directed to CLA-rich vegetable oil production from linoleic rich oils by heterogeneous catalysis, and more particularly, the invention is directed to a process for producing conjugated PUFA in triglyceride form, preferably at least 20% CLA-rich oil, by isomerization of a non-conjugated PUFA in vegetable oils using a heterogeneous transition metal catalyst promoted by an organic acid and/or thiol-containing compound. The heterogeneous catalysis isomerization process can use steam/vacuum distillation, pressure vessel, and/or deodorization equipment to produce CLA-rich soy oil. After processing, any catalyst residue may be removed by filtration, bleaching, deodorizing, adsorbents, centrifugation or other separation methods to obtain high quality, CLA-rich oils. The CLA-rich oils may then serve as a potent and bioactive nutraceutical. In addition, the CLA-rich oils can be incorporated into various food products, such as a CLA-rich dressing, shortening, margarine, chocolate or chips. Moreover, the CLA-rich oils can be used in poultry and animal feed, as well as drying oils in paints, varnishes and plastics.

The heterogeneous catalysis process utilizes a metal catalyst that can be selected from any suitable transition metal, such as ruthenium, rhodium, platinum, iridium, osmium, palladium, silver and nickel. Nickel catalysts can be any form of nickel including nickel(II) and their compounds with all anions, e.g., the sulfide, sulfate, carbonate, hydroxide, carboxylates, oxides, and halides, preferably metal nickel, nickel sulfide (NiS), and nickel formate $Ni(COO)_2$, and more preferably, metal nickel distributed on silica/alumina. Nickel alloys with iron, aluminum, chromium and carbon loaded on silica/alumina, and organic amino and thiol compounds self-assembly monolayer modified nickel catalysts may also be utilized.

Promoter compounds can be any organic proton donors and monosulfides, disulfides and mercaptans and/or their mixtures, such as methanol, ethanol, isopropyl alcohol, formic acid, acetic acid, benzoic acid, 2-mercaptoethanol, ethanethiol, 1,2-ethanedithiol, L-cysteine, cysteamine, thiolactic acid, and mercaptosuccinic acid, preferably acetic acid, formic acid, L-cysteine, and mercaptosuccinic acid and/or their mixtures, and more preferably, mixture of formic acid and L-cysteine.

EXAMPLES

The CLA-rich vegetable oil production from linoleic rich oils by heterogeneous catalysis disclosed herein is further illustrated by the following examples, which are provided for the purpose of demonstration rather than limitation. Although soy oil was used in the following examples, any linoleic acid-rich oil can be used. RUBSO was used to avoid an additional bleaching step to remove any residual catalyst.

In one aspect, the invention may use formic acid as steam distillation and ruthenium and nickel heterogeneous catalysis to produce CLA-rich soy oil. Formic acid is mixed with soy oil, in the deodorizing steam and/or as a pretreatment of the catalyst, in order to dramatically increase the CLA yield, namely a 26% CLA oil can be obtained in 1 hour at 210° C. with 0.064% ruthenium and 10% formic acid in the oil using 85% formic acid as the steam.

In another aspect, the invention may use pressure vessel under high temperature, high pressure processing, with the addition of formic acid under nitrogen pressure with bleeding of nitrogen.

In another aspect, the invention may use a heterogeneous catalysis process with catalyst promoted compounds, namely nickel in the presence of formic acid and/or cysteine, in the under inert gas pressure to enhance the catalytic conversion rate from linoleic acid to CLAs in vegetable oils.

Example 1

Example 1 demonstrates the unexpectedly superior results of formic acid mixed with soy oil, in the deodorizing steam supply and as a pretreatment of a transition metal catalyst on the CLA yield to reduce the need for a catalyst. In this Example, CLA-rich oil having up to 26% CLA in the oil was produced using 10% formic acid mixed with soy oil and 85% formic acid in the deodorizing steam when processed at 210° C. at <5 mm Hg pressure for 1-2 hours. Variable levels of 0-0.064% catalyst doses and processing time and temperatures were used to produce up to 26% CLA in the oil. Formic acid was recovered and reused from the condensate and the solid catalyst recovered from the oil. The CLA-rich vegetable oil was produced from RUBSO using a single step ruthenium-based heterogeneous catalysis method with a significantly reduced ruthenium catalyst dose.

RUBSO for Example 1 was obtained from Riceland Foods (Stuttgart, Ark.) with linoleic acid (55.9%) and linolenic acid (6.9%), as measured by a gas chromatography-flame ionization detector (GC-FID). Heptadecanoic acid methyl ester (17:0; Sigma-Aldrich, St. Louis, Mo.) was used as a standard for GC-FID analysis. Sodium methoxide and anhydrous sodium sulfate (EM Science, Darmstadt, Germany) were used for methyl ester preparation. Ruthenium and nickel, 10% on reduced, activated powder carbon, catalyst and 85% formic acid were purchased from Alfa Aesar (Ward Hill, Mass.). Charcoal activated granular and activated carbon were purchased from Sigma-Aldrich (St. Louis, Mo.). Samples of Sorbsil R90 and R40 were obtained from PQ Corporation (Joliet, Ill.). A sample of bleaching clay, Select 350, was obtained from Oil-Dri (Chicago, Ill.). Citric acid was purchased from AMRESCO (Solon, Ohio). A laboratory scale oil deodorization unit with a modified steam container and condenser was purchased from O'Brien's Scientific Glassblowing (Monticello, Ill.). A glass microfiber filter with the pore size of 0.7 μm was purchased from Whatman (VWR International, Radnor, Pa.).

A laboratory scale oil deodorization unit (100) as exemplified in FIG. 1 was used, and the unit included a 500 mL water reservoir (102) to generate and deliver steam at a rate of 1 mL/min by a 250-watt infrared bulb (104) that heated the water in the water reservoir (102). The 500 mL round bottom reaction flask (106) placed in the heating mantle (108) contained the RUBSO (110) to be processed, catalyst and formic acid. A thermometer (112) was inserted through a ground glass joint into the bottom of the flask (106) to continuously monitor temperature and the condensers (114, 116) were cooled with the dry ice-acetone mixture (118). All the vapors were retained by the first condenser (114) and the second condenser (116) acted as a safety device in case of failure of the first condenser (114). The formic acid that condensed in the condenser (114) was recovered and could have been reused after the dry ice disappeared into the open air. The outlet of the second condenser (116) was connected directly to the vacuum pump (120) to maintain a vacuum of 1-5 mmHg pressure throughout the assembly (100). The pressure was maintained by using a dual high vacuum pump (120) (Welch Vacuum Technology, Skokie, Ill.) to prevent oil oxidation and maintain the steam supply to the flask (106).

Effect of added formic acid in soy oil and added formic acid to the steam on CLA yields: Formic acid at concentrations of 0, 1, 5, 10, and 20% (w/w) by the weight of RUBSO was added to the flask containing a mixture of 200 g RUBSO and ruthenium catalyst (0.064%), respectively. Approximately 500 mL of 85% formic acid was added into the steam reservoir. Processing was conducted in duplicate at each formic acid concentration in the oil at 210° C. for 1 h at <5 mmHg pressure.

Figure 2:
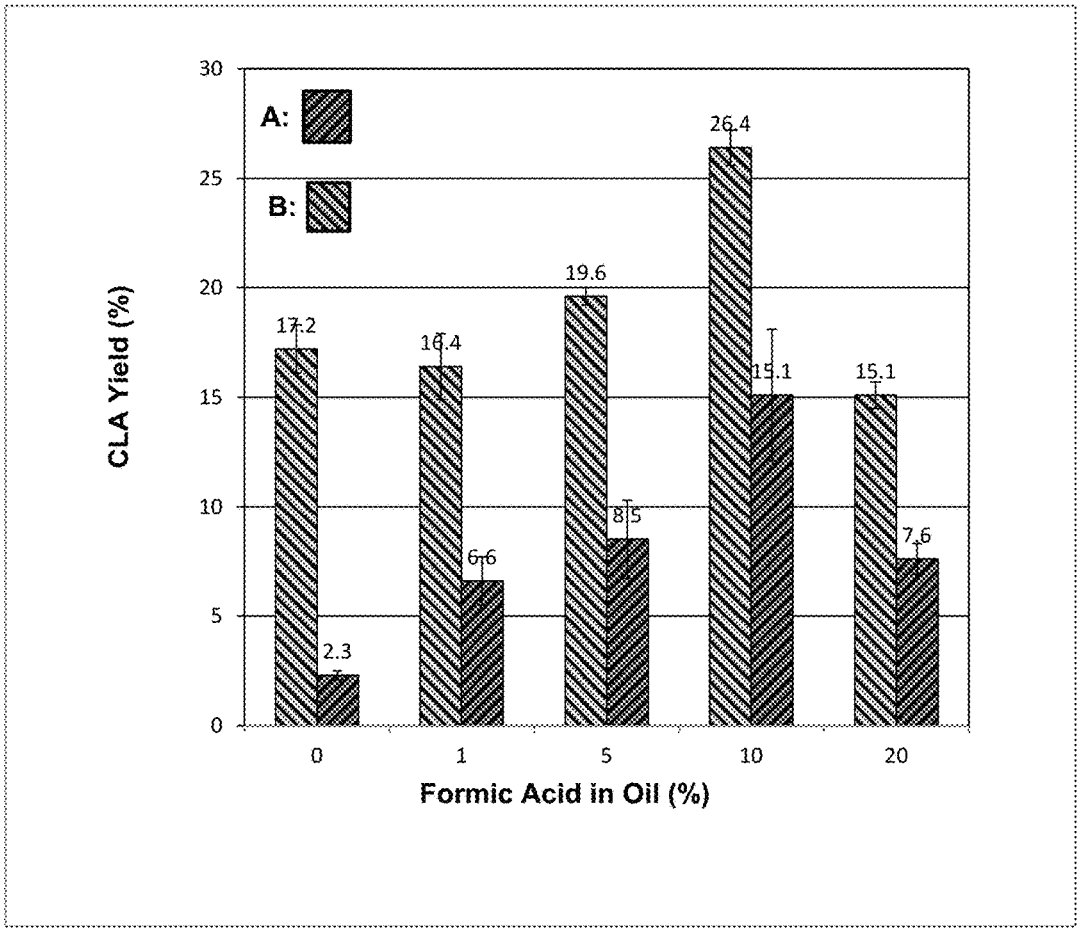
FIG. 2 graphically illustrates the effects 0-20% formic acid (w/w) added to soy oil on the CLA yields when processed with 0.064% of ruthenium at 210° C. for 1 hr at <5 mmHg pressure using: (A) deodorizer steam as water; and (B) deodorizer steam as 85% formic acid, in accordance with an illustrative embodiment of the CLA-rich vegetable oil production from linoleic rich oils by heterogeneous catalysis disclosed herein.

FIG. 2 graphically illustrates the effects on CLA yield when formic acid is added to soy oil using either water-steam or 85% formic acid as steam and in the presence of 0.064% ruthenium metal at 210° C. for 1 h reaction time at a pressure of <5 mmHg. As can be seen, formic acid as steam distillation elevated CLA yields significantly relative to steam alone, at all formic acid oil levels, with the maximum yield of 26.4% CLA being produced under optimal conditions with 10% formic acid in the oil and 0.064% of ruthenium catalyst. CLA yields increased as oil formic acid was increased in the range of 0-10% with both steam treatments. As noted below, however, there was a large, significant CLA yield reduction with 20% oil formic acid, likely due to formic acid poisoning the catalyst.

Effect of 10% soy oil formic acid and 85% formic acid as steam on CLA-rich soy oil total fatty acid composition: Table 1 below shows the fatty acid composition of CLA-rich oil produced with 10% formic acid in the oil and 85% formic acid as steam relative to a CLA-rich oil produced without formic acid. As can be seen, only 2.2% total CLA was produced without formic acid, with about 6.9% of this being t,t, CLA, whereas the total CLA was increased dramatically to 26% in the formic acid system, with about 20% of this being t,t, CLA. These conversions were accompanied by a corresponding loss of linoleic acid. In addition, 4% and 1% conjugated linolenic acid (CLnA) was catalytically produced with and without formic acid, respectively. A corresponding loss in linolenic acid was also observed.

TABLE 1

Fatty acid compositions of unbleached soy oil and CLA-rich soy oil from that oil obtained in the presence of 0.064% of ruthenium, at 210° C. for 1 h at <5 mm Hg pressure.

| Fatty Acid Compositions | Unbleached Soy Oil (%) | CLARSO (%) water as steam | CLARSO (%) 10% formic acid in oil and 85% formic acid as steam |
|---|---|---|---|
| $C_{16:0}$ | 9.43 ± 0.14a | 11.08 ± 0.13b | 12.35 ± 0.25c |
| $C_{18:0}$ | 4.02 ± 0.05a | 3.90 ± 0.12a | 4.39 ± 0.13b |
| $C_{18:1}$ | 23.85 ± 0.18a | 23.94 ± 0.03a | 25.61 ± 0.59b |
| $C_{18:2}$ | 55.87 ± 0.08a | 53.04 ± 0.43b | 20.96 ± 0.23c |
| $C_{18:3}$ | 6.96 ± 0.00a | 5.80 ± 0.11b | 0.56 ± 0.04c |
| Others | 0.58 ± 0.01a | 0.48 ± 0.11a | 5.75 ± 0.13b |
| $CLA_{c,t/t,c}$ | 0.00a | 2.08 ± 0.03b | 21.20 ± 1.19c |
| $CLA_{t,t}$ | 0.00a | 0.16 ± 0.03b | 5.21 ± 0.30c |
| Total CLA | 0.00a | 2.2 ± 0.1b | 26.4 ± 0.88c |
| CLnA | 0.00a | 1.1 ± 0.14b | 4.07 ± 0.09c |

As can be further seen in Table 1 above, oleic acid levels were unchanged by processing in the absence of formic acid but it was increased significantly with formic acid. Similarly, there are small increases in palmitic acid and stearic acid in both systems suggesting the possibility conversion palmitic and oleic acid, respectively, by the same mechanism. Nevertheless, all these changes are only in order of 1-2% and within the margin of experimental error.

Effect of ruthenium with formic acid pretreatment on CLA yields: Pretreatment of ruthenium was conducted by mixing 1.28 g of ruthenium catalyst and 20 g formic acid for 1 h. After mixing, the mixture was added into the flask reactor containing 200 g of RUBSO. The mixture was then processed in duplicate at 210° C. for 1 h at <5 mm Hg pressure. In an additional experiment, duplicate mixtures of ruthenium catalyst (1.28 g) and formic acid (20 g) were filtered using a filtration paper. Both ruthenium catalyst duplicates were recovered and each added into a flask reactor containing 200 g of RUBSO and processed at 210° C. for 1 h under the pressure less than 5 mmHg. In yet another experiment, after filtration, the duplicate formic acid solutions were each added to flasks containing 200 g of RUBSO, and processed at 210° C. for 1 h at <5 mmHg pressure.

Table 2 shows the effects of these various pretreatments on total CLA yields. As illustrated, catalyst and formic acid together produced the most CLA. There was synergistic effect as this treatment produced almost double the CLA than when the catalyst and acid were used separately. Furthermore, the formic acid solution alone did not produce any CLA, and acted as the same as the control formic acid, which was ineffective. This suggests that catalyst dissolved in the acid did not contribute the catalysis isomerization of linoleic acid. The catalyst activation by formic acid could be the mechanism of enhancing catalytic conversion of CLA from linoleic acid.

TABLE 2

Duplicate catalyst pre-treatments were obtained by mixing 0.064% ruthenium catalyst with 10% formic acid for 1 hour with water steam. The following were used to evaluate their effect on CLA production from soy oil: (1) catalyst with formic acid; (2) catalyst; (3) formic acid; (4) 10% formic acid (control), not used in the pretreatment.

| Catalyst used after pretreatment | CLA Yield (%) |
|---|---|
| 1. Ru catalyst + 10% formic acid | 15.1 ± 0.7b |
| 2. Ru catalyst | 7.4 ± 1.4c |
| 3. Formic acid solution alone | 0.15 ± 0.07a |
| 4. Formic acid (control) | 0.1 ± 0.05 a |

Fatty acid determination: CLA-rich soy oil fatty acid methyl esters (FAMEs) were produced and the fatty acid composition of CLA-rich oils was analyzed in duplicate as FAME by GC using a SP2560 fused silica capillary column (100 m ×0.25 mm i.d.×0.2 μm film thickness; Supelco Inc., Bellefonte, Pa.) with a flame ionization detector model 3800 Varian (Walton Creek, Calif.). A 2 ml sample in hexane was injected using an auto sampler CP8400 (Varian), and chromatograms were collected by Galaxie chromatography workstation 1.9.3.2 (Varian). Analysis of variance was used to determine significant difference in CLA-rich soy oil compositions and between treatments.

Effect of catalyst doses on CLA yield: The catalyst doses on CLA yield were studied by processing soy oil at 210° C. for 1 h with the different catalyst doses ranging from 0 to 0.064% in 10% formic acid in soy and 85% formic acid as the steam. The experiments at each specific catalyst dose were conducted in duplicated.

Figure 3:
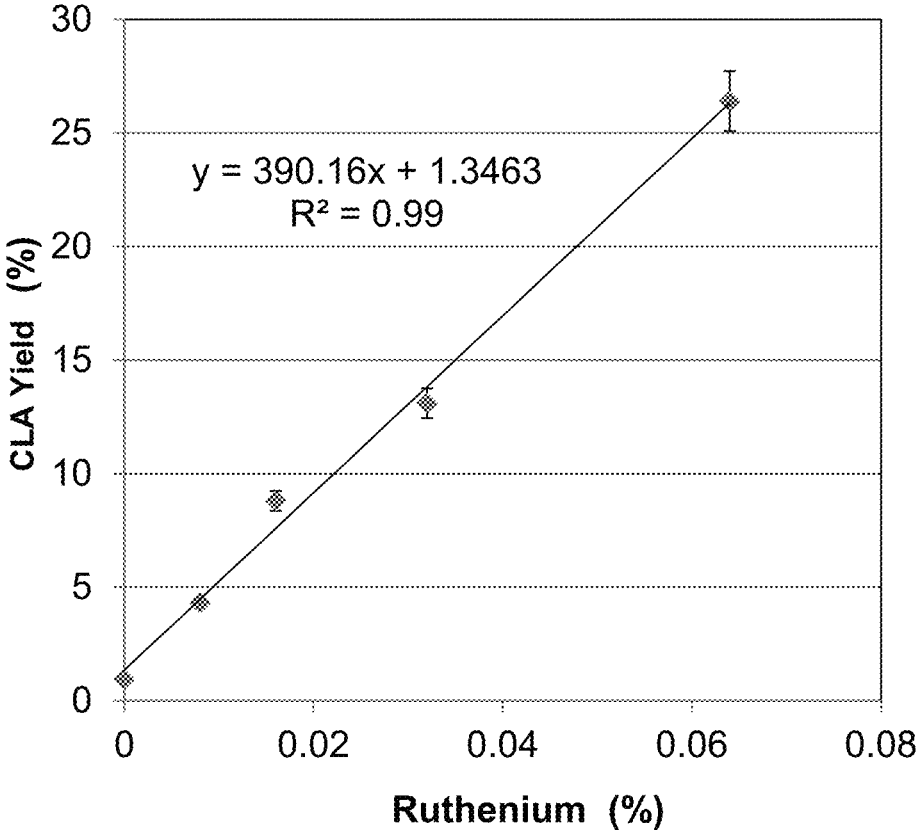
FIG. 3 graphically illustrates the effect of ruthenium catalyst dose on the CLA yield in a once refined soy oil in the presence of 10% of formic acid in oil, and 85% formic acid as steam at 210° C. for 1 h processing.

FIG. 3 shows the effect of the dose of ruthenium catalyst on the CLA yield when used with formic acid. As illustrated, CLA yield increases linearly with ruthenium catalyst in the range of 0-0.064% doses to produce up to 26% CLA ($r^2$=0.99). Therefore, using the inventive process disclosed herein, catalyst doses can be varied while keeping other processing conditions constant to achieve various CLA yields for specific applications.

Effect of temperature on CLA yield and fatty acid composition: The effect of temperature on CLA yield and fatty acid composition was studied by processing soy oils in duplicate with 10% formic acid at the following temperatures of 140, 170, 190, 210, 230, and 250° C., with 0.064% ruthenium catalyst using 85% formic acid as steam for 2 hrs.

Table 3 shows that the highest CLA yield was obtained at 210° C. when processing for 2 hours with 0.064% ruthenium catalyst, with yields decreasing at lower and higher temperatures. Temperature also affected the CLA isomer distribution; at a lower temperature of 140° C., the main CLA isomers were cis-9, trans-11 and trans-10, cis-12 with only about 5% trans, trans CLA. In contrast, at 250° C., there was an increase to about 20.7% of trans, trans CLA. Levels of CLnA were greatest at 210° C. with 5% levels and ranged from 1-5% in the experiment, and were accompanied by a corresponding loss of linolenic acid. Palmitic acid (C16:0), stearic acid (C18:0) and oleic acid (C18:0) levels were unchanged and independent of processing temperature.

TABLE 3

Effect of temperature on CLA yield and fatty acid composition in the presence of 0.064% of ruthenium for 2 hrs with 10% formic acid in soy oil using 85% formic acid as steam at <5 mm Hg pressure.

| Fatty Acid | Temperature (° C.) | | | | | |
|---|---|---|---|---|---|---|
| Composition | 140 | 170 | 190 | 210 | 230 | 250 |
| $C_{16:0}$ | 12.22 ± 0.57a | 12.55 ± 0.10a | 11.68 ± 0.08a | 13.27 ± 0.19a | 12.34 ± 0.20a | 12.03 ± 0.20a |
| $C_{18:0}$ | 4.15 ± 0.18a | 4.14 ± 0.16a | 4.13 ± 0.03a | 4.77 ± 0.03a | 4.37 ± 0.12a | 4.28 ± 0.17a |
| $C_{18:1}$ | 25.89 ± 1.05a | 26.58 ± 0.07a | 24.18 ± 0.22a | 24.10 ± 0.06a | 24.92 ± 0.08a | 24.23 ± 0.08a |
| $C_{18:2}$ | 47.11 ± 2.24a | 26.55 ± 0.01b | 25.39 ± 0.34c | 13.93 ± 0.94d | 27.53 ± 0.86e | 19.63 ± 0.86f |
| $C_{18:3}$ | 4.38 ± 0.78a | 1.51 ± 0.72b | 0.85 ± 0.03c | 0.17 ± 0.07d | 0.96 ± 0.04c | 0.32 ± 0.02d |
| Others | 0.15 ± 0.00a | 3.46 ± 0.65b | 4.77 ± 0.23c | 9.07 ± 0.34d | 1.7 ± 0.07e | 7.23 ± 0.47f |
| CLA $_{c,t/t,c}$ | 4.79 ± 0.20a | 18.19 ± 1.25b | 20.34 ± 0.32c | 22.21 ± 1.3c | 19.38 ± 1.5c | 21.64 ± 1.10c |
| CLA $_{t,t}$ | 0.25 ± 0.01a | 2.58 ± 0.86b | 3.93 ± 0.13c | 7.28 ± 0.87d | 3.99 ± 0.02c | 5.67 ± 0.07e |
| Total CLA | 4.90 ± 0.01a | 20.77 ± 1.55b | 24.05 ± 0.19c | 29.49 ± 1.3d | 23.37 ± 0.27e | 27.3 ± 1.47d |
| CLnA | 1.35 ± 0.05a | 4.44 ± 0.16b | 4.95 ± 0.09b | 5.02 ± 0.08b | 4.75 ± 0.09b | 4.98 ± 0.05b |

Effect of processing time on CLA yield and fatty acid composition: The effect of processing time on CLA yield and fatty acid composition was conducted by processing soy oil in duplicate with 10% formic acid at processing times of 30, 60, 90, 120, 180 min, at 210° C. in the presence of 0.064% ruthenium using 85% of formic acid as steam. Fatty acids were determined as FAMEs by GC.

Table 4 shows the effect of processing time on CLA yield and fatty acid composition. As can be seen, CLA yield increased with the increase of processing time up to 90 minutes and then remained constant. However, trans, trans CLA increased with processing time, whereas linolenic acid decreased with increase of CLnA and processing time. Linolenic acid was not detected after 3 hours, and palmitic acid (C16:0), stearic acid (C18:0) and oleic acid (C18:0) levels remained constant with increased processing time.

TABLE 4

Effect of processing time on CLA yield and fatty acid composition in the presence of 0.064% ruthenium at 210° C. with 10% formic acid in soy oil using 85% formic acid as steam at <5 mm Hg pressure.

| Fatty Acid | Processing Time (min.) | | | | |
|---|---|---|---|---|---|
| Composition | 30 | 60 | 90 | 120 | 180 |
| $C_{16:0}$ | 12.24 ± 0.12a | 12.35 ± 0.25a | 12.75 ± 0.35a | 13.27 ± 0.19a | 12.95 ± 0.10a |
| $C_{18:0}$ | 4.15 ± 0.15a | 4.39 ± 0.13a | 4.48 ± 0.05a | 4.77 ± 0.03a | 4.62 ± 0.02a |
| $C_{18:1}$ | 25.45 ± 0.3a | 25.61 ± 0.59a | 25.73 ± 0.07a | 24.10 ± 0.06a | 25.50 ± 0.12a |
| $C_{18:2}$ | 33.67 ± 1.13a | 20.96 ± 0.23b | 14.96 ± 1.08c | 13.93 ± 0.94c | 13.44 ± 0.02c |
| $C_{18:3}$ | 2.15 ± 0.7a | 0.56 ± 0.04b | 0.25 ± 0.03c | 0.17 ± 0.07d | 0.00e |
| Others | 2.97 ± 1.1a | 5.75 ± 0.13b | 7.58 ± 0.22c | 9.07 ± 0.34d | 10.59 ± 0.02e |
| CLA $_{c,t/t,c}$ | 15.52 ± 1.83a | 21.20 ± 1.19b | 22.93 ± 1.24b | 22.21 ± 1.3b | 21.19 ± 0.04b |
| CLA $_{t,t}$ | 2.13 ± 0.9a | 5.21 ± 0.30b | 6.34 ± 0.59c | 7.28 ± 0.87d | 7.20 ± 0.22d |
| Total CLA | 17.9 ± 2.36a | 26.4 ± 0.88b | 29.26 ± 1.2c | 29.49 ± 1.3c | 28.21 ± 0.87c |
| CLnA | 2.05 ± 1.50a | 4.07 ± 0.09b | 4.99 ± 0.06c | 5.02 ± 0.08c | 4.40 ± 0.09d |

Effect of commercial adsorbents on removal of ruthenium catalyst residue: After processing of RUBSO at 210° C. for 1 h in the presence of 0.064% ruthenium and 10% formic acid in the oil using 85% of formic acid as steam, the mixture CLARSO oil was centrifuged and then was filtered with filter paper (0.7 μm, Whatman) to remove catalyst. The CLARSO was bleached at 95° C. for 30 min using the oil deodorization unit in the presence of 2% Sorbsil silica R40 (Joliet, Ill.), 2% Sorbsil silica R 90 (Joliet, Ill.), 2% AOCS official bleaching earth (Champaign, Ill.), 2% charcoal activated granular (St. Louis, Mo.), activated carbon particles (St. Louis, Mo.), 2% bleaching clay Select 350 (Oil Dri, Chicago, Ill.), or 5% bleaching clay Select 350 with 1% citric acid by the weight of CLARSO. The bleached oil was filtered with filter paper with pore size of 0.7 μm to remove adsorbents. Ruthenium residues in CLARSO samples were determined by Laboratory Testing Inc. (Hatfield, Pa.) using ICP-MS.

Figure 4:
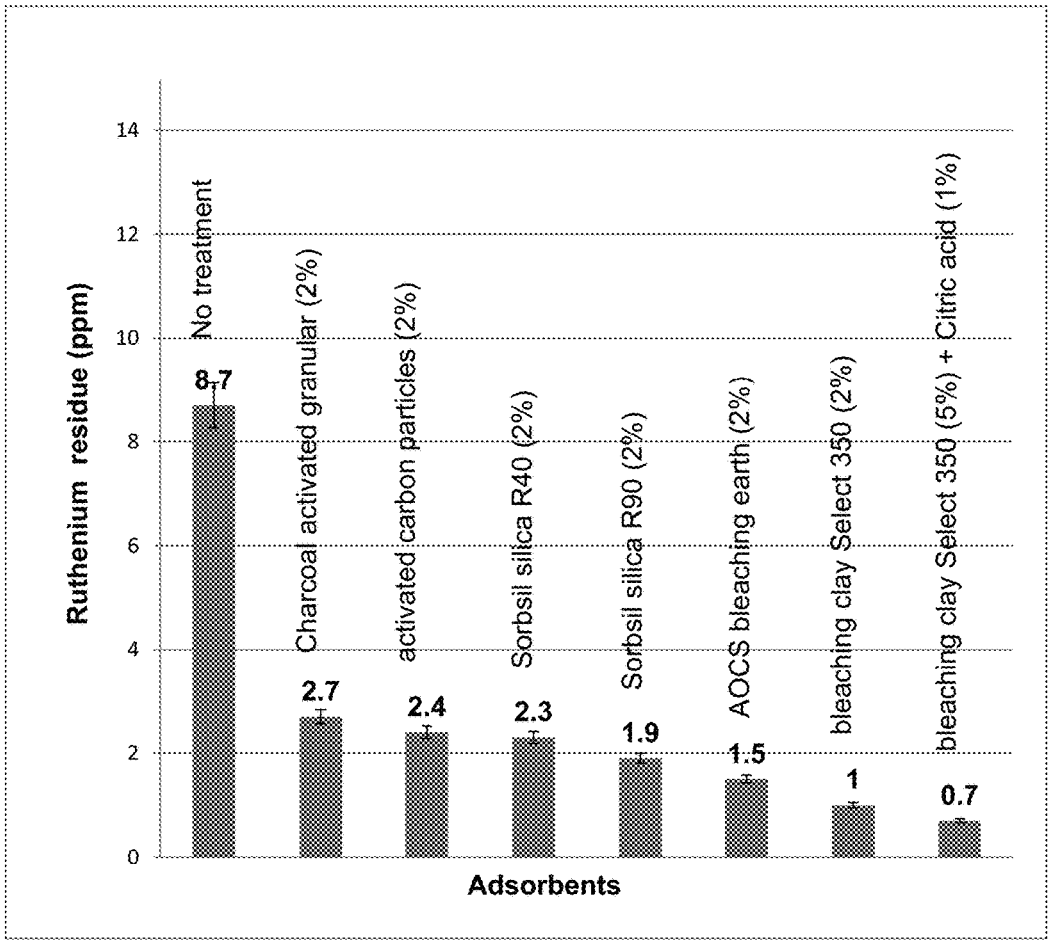
FIG. 4 graphically illustrates the effect of adsorbents on catalyst residue in CLA-rich soy oil after bleaching at 95° C. for 30 minutes.

After processing of RUBSO at 210° C. for 1 h in the presence of 0.065% ruthenium and 10% formic acid in the oil using of formic acid as steam, there was approximately 8.7 ppm ruthenium in CLARSO (FIG. 4). FIG. 4 shows the mean ruthenium concentration after each adsorbent treatment to remove residual ruthenium. As can be seen, all the adsorbents used at 2% level greatly decreased residual catalyst levels; however, Select 350 clay was the most effective adsorbent at 2% dose. The addition of 1% citric acid to 5% Select 350 reduced residual levels to 0.7 ppm, which is comparable with the nickel contents in edible vegetable oils of 0.2 ppm.

As can be seen from the results of Example 1, CLA-rich soy oil can be produced from unbleached soy oil with increased CLA content using a decreased catalyst dose with 10% formic acid in the oil and 85% formic acid in the steam when processed at 210° C. at <5 mm Hg pressure for 1-2 hours. Variable levels of 0-0.064% catalyst can be used to produce up to 26% CLA in the oil. Formic acid can be recovered and reused from the condensate and the solid catalyst recovered from the oil.

Example 2

Example 2 demonstrates the production of CLA-rich vegetable oil with no or low trans-fat using a single step transition metal-based heterogeneous catalysis process with a catalyst promoted compound in the absence of hydrogen and air using an oil deodorizer to enhance the catalytic conversion rate from linoleic acid to CLAs in vegetable oils. In this Example 2, a synergistic augmentation effect of catalyst, formic acid and promoter on the production of CLA was determined, along with the effects of catalyst dose and the amount of promoter in the oil deodorizer on CLA yield.

Once refined, refined bleached deodorized soy oil (RBDSO) was obtained from Riceland Foods (Stuttgart, Ark.) with appropriate linoleic acid (55.9%) and linolenic acid (6.9%), as measured by GC-FID. Heptadecanoic acid methyl ester (17:0; Sigma-Aldrich, St. Louis, Mo.) was used as a standard for GC-FID analysis. Sodium methoxide and anhydrous sodium sulfate (EM Science, Darmstadt, Germany) were used for methyl ester preparation. Nickel catalyst, 66% on reduced, activated powder carbon catalyst and formic acid 95% were purchased from Alfa Aesar (Ward Hill, Mass.). Nickel catalyst samples, Pricat 9925 and Pricat 9910, were obtained from Johnson Matthey.

Oil Deodorizer Processing Unit: Laboratory scale oil deodorization unit as utilized above in Example 1 was used with some modifications. A 500 mL water reservoir for steam was used to deliver steam at a rate of 1 mL/min for heating in the reservoir. The 1 L round bottom reaction flask placed in the heating mantle contained the soy oil to be processed, catalyst, cysteine and formic acid. A thermometer was inserted through a ground glass joint into the bottom of the flask to continuously monitor temperature. The efficiency of the condensers was increased by using condensers with the inner diameter of 7.5 cm, and the condensate was retained by the first condenser.

In order to demonstrate a synergistic augmentation effect of catalyst, formic acid and promoter on the production of CLA, a series of four (4) experiments were conducted. In a first experiment, RBDSO of 200 g was added into 250 mL flask, 10% nickel catalyst was then added into above 200 g soy oil, 500 ml water was added into water reservoir in the oil deodorizer unit. The mixture was then heated to 210° C. for 90 min at <5 mmHg pressure. In a second experiment, RBDSO of 200 g was added into 250 mL flask, 10% nickel catalyst and 10% (by the weight of soy oil) of formic acid (85% to water) was then added into above 200 g soy oil, 500 ml of formic acid (85% to water) was added into water reservoir in the oil deodorizer unit. In a third experiment, RBDSO of 200 g was added into 250 mL flask, 10% nickel catalyst and 0.5% (by the weight of soy oil) of cysteine was then added into above 200 g soy oil, 500 ml of water was added into water reservoir in the oil deodorizer unit. Lastly, in a fourth experiment, RBDSO of 200 g was added into 250 mL flask, 10% nickel catalyst, 10% (by the weight of soy oil) of formic acid (85% to water) and 0.5% (by the weight of soy oil) of cysteine was then added into above 200 g soy oil, 500 ml of formic acid (85% to water) was added into water reservoir in the oil deodorizer unit.

Effect of added formic acid and added cysteine in soy oil on CLA yields: Table 5 below shows the results of the soy oil processed at 210° C., a pressure<5 mmHg in the presence of 10% nickel catalyst for 90 min. As indicated from data in Table 5, there is an approximate 10 times increase in CLA yield in the presence of 10% formic acid and with 85% formic acid as steam compared with soy oil processed without formic acid at the same processing conditions. The CLA yield without formic acid was only 0.56% even in the presence of very high amount (10%) of nickel catalyst used in the soy oil, demonstrating that formic acid promoted isomerization reaction of linoleic acid to CLA in soy oil. CLA yield also increased around 10 times in the presence of 0.5% cysteine alone in comparison with control experiment without cysteine processed at the same conditions. There is an about 59 times increase in CLA yield in the presence of both formic acid (10% in soy oil, 85% formic acid as steam) and cysteine (1%). These unexpectedly superior results clearly indicated that there is a synergistic augmentation effect of formic acid and cysteine with nickel catalyst to the production of CLA-rich oil.

TABLE 5

Effect of formic acid and cysteine on CLA yield in oil deodorizer processed at 210° C., a pressure <5 mmHg in the presence of 10% nickel catalyst for 90 min.

| Reaction Parameters | CLA yield (%) |
|---|---|
| Soy oil | 0.56 ± 0.11 |
| Soy oil + formic acid (10%) + formic steam (85% to water) | 6.05 ± 1.91 |
| Soy oil + cysteine (0.5%) + water steam | 5.4 ± 2.1 |
| Soy oil + formic acid (10%) + cysteine (1%) + formic steam (85%) | 32.9 ± 2.5 |

Effect of nickel dose on CLA yield: RBDSO of 200 g was added into 250 mL flask, 10% (by the weight of soy oil) of formic acid (85% to water) and 1% (by the weight of soy oil) of cysteine and nickel catalyst with 0.82%, 1.63%, 3.25, and 6.5% for each experiment was then added into 200 g soy oil, 500 ml of formic acid (85% to water) was added into water reservoir in the oil deodorizer unit. All experiments were performed at 210° C. and <5 mmHg pressure for 2 hrs.

Figure 5:
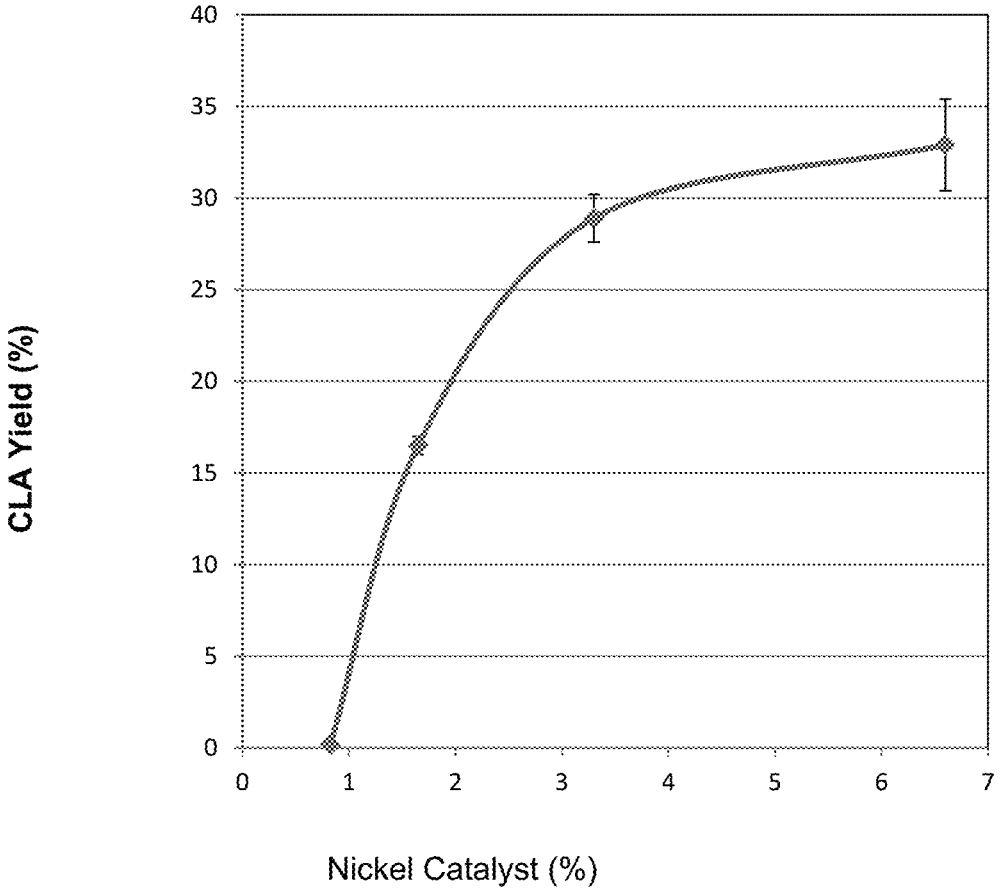
FIG. 5 graphically illustrates the effect of nickel catalyst dose on CLA yield in the presence of 10% formic acid in oil, 85% formic acid as steam and 1% of cysteine in oil processed at 210° C., a pressure<5 mmHg for 2 hrs.

FIG. 5 shows effect of nickel catalyst dose on CLA yield in the presence of 10% formic acid in oil, 85% formic acid as steam and 1% of cysteine in oil processed at 210° C., a pressure<5 mmHg for 2 hrs. When nickel catalyst is lower than 3.3% by the weight of oil, CLA yield increased almost linearly, with further increases in catalyst dose slowly increasing CLA. Up to 35% CLA can be obtained when 6.6% of nickel catalyst was used in the processing in oil deodorizer.

Effect of cysteine on CLA yield: RBDSO of 200 g was added into 250 mL flask, 3.25% nickel, 10% (by the weight of soy oil) of formic acid (85% to water) and cysteine with the amount of 0, 0.1%, 0.25%, 0.5%, 1%, 2% and 3.25% for each experiment was then added into 200 g soy oil, 500 ml of formic acid (85% to water) was added into water reservoir in the oil deodorizer unit. All experiments were performed at 210° C. and <5 mmHg pressure for 2 hrs.

Figure 6:
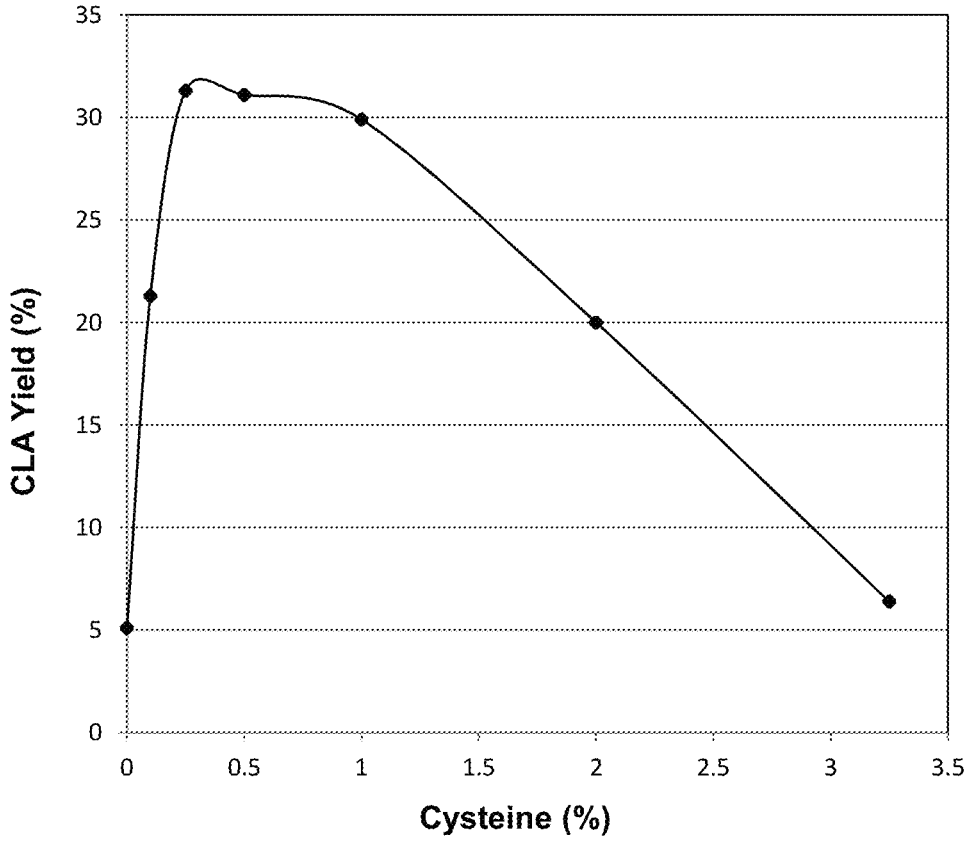
FIG. 6 graphically illustrates the effect of cysteine in oil on the CLA yield in the presence of 3.25% nickel, 10% formic acid in oil, 85% formic acid as steam processed at 210° C., a pressure<5 mmHg for 2 hrs.

FIG. 6 shows effect of cysteine in oil on the CLA yield in the presence of 3.25% nickel, 10% formic acid in oil, 85% formic acid as steam processed at 210° C., a pressure<5 mmHg for 2 hrs. High CLA yield was obtained when cysteine from 0.25% to 1% by the weight of soy oil. CLA yield rapidly decreases when cysteine is higher than 1% due likely to the poison of cysteine to nickel. If cysteine is too low (<0.25%) CLA yield is also decreasing because nickel surfaces are not fully covered by cysteine.

Example 3

Example 3 demonstrates the inventive process disclosed herein used to produce CLA-rich vegetable oil with no or low trans-fat using a single step transition metal-based, namely nickel, heterogeneous catalysis process with catalyst promoted compounds, namely organic acids and thiol compounds, in the absence of hydrogen and air with a hydrogenation unit to enhance the catalytic conversion rate from linoleic acid to CLAs in vegetable oils. In this Example 3, the synergistic augmentation effect of nickel catalyst, formic acid and cysteine on the production and yield of CLA was further demonstrated, along with effect of the operational parameters, namely temperature, processing time, mixing speed, and types of catalyst materials, on the CLA yield and the trans-oleic acid in the hydrogenation unit.

Similar to the other examples, once refined, RBDSO was obtained from Riceland Foods (Stuttgart, Ark.) with appropriate linoleic acid (55.9%) and linolenic acid (6.9%), as measured by GC-FID. Heptadecanoic acid methyl ester (17:0; Sigma-Aldrich, St. Louis, Mo.) was used as a standard for GC-FID analysis. Sodium methoxide and anhydrous sodium sulfate (EM Science, Darmstadt, Germany) were used for methyl ester preparation. Nickel catalyst, 66% on reduced, activated powder carbon catalyst and formic acid 95% were purchased from Alfa Aesar (Ward Hill, Mass.). Nickel catalyst samples, Pricat 9925 and Pricat 9910, were obtained from Johnson Matthey. Hydrogenation unit (1 L) was purchased from Parr Instrument Company (Moline Ill.). Laboratory scale oil deodorization unit with a modified steam container and condenser was purchased from O'Brien's Scientific Glassblowing (Monticello, Ill.). A syringeless filter with the pore size of 0.2 μm was purchased from Whatman (VWR International, Radnor, Pa.).

Oil Hydrogenation Processing Unit: Hydrogenation unit 4530 with 4848*b* reactor controller was connected to a computer. Reaction temperature was set up using a 4848*b* software. Pressure was adjusted using nitrogen gas. The processing temperature and mixing rate were input from the computer. All experiments were monitored with a 4848*b* reactor controller software provided by Parr Instrument. Experiments were conducted in both sealed and nitrogen bleeding modes. Soy oil of 500 g was first added into the 1 L reactor, and nickel catalyst, cysteine, and formic acid were then added to the reactor. Before heating, the soy oil mixture was placed under nitrogen pressure of 50 psi, the nitrogen pressure was released down to 0.0 psi, and then the process was repeated about 6 times to remove any trace amount of oxygen trapped in soy oil.

Similar to above with regard to the oil deodorizer processing unit of Example 2, in order to demonstrate a synergistic augmentation effect of nickel catalyst, formic acid and cysteine on the production of CLA using an oil hydrogenation processing unit, a series of three (3) experiments were conducted. In the first experiment, RBDSO of 200 g was added into 1 L reactor, 1% nickel catalyst by the weight of soy oil was then added into above 200 g soy oil. After oxygen was removed with flushing of nitrogen gas, the oil was processed at 210° C., a pressure of 38 psi and a mixing speed of 800 rpm for 2 hrs. In the second experiment, RBDSO of 200 g was added into 1 L reactor, 1% nickel catalyst and 1% of formic acid by the weight of soy oil was then added into above 200 g soy oil. After oxygen was removed with flushing of nitrogen gas, the oil was processed at 210° C., a pressure of 38 psi and a mixing speed of 800 rpm for 2 hrs. Finally, the third experiment, RBDSO of 200 g was added into 1 L reactor, 1% nickel catalyst, 1% of formic acid and 0.1% of cysteine, all by the weight of soy oil were then added into above 200 g soy oil, respectively. After oxygen was removed with flushing of nitrogen gas, the oil was processed in a sealed system at 210° C., a pressure of 38 psi and a mixing speed of 800 rpm for 2 hrs.

Effect of added fFormic acid and added cysteine in soy oil on CLA yields processed with hydrogenation unit: Table 6 shows the results of the soy oil processed at 210° C., a pressure of 38 psi in the presence of 1% nickel catalyst for 2 hrs with and without formic acid. It is indicated from data in Table 6 that there is an approximate 11 times increase in CLA yield in the presence of 1% formic acid compared with soy oil processed without formic acid at the same processing conditions. The CLA yield without formic acid was only 0.21% in the presence of 1% of nickel catalyst used in the soy oil, demonstrating that formic acid promoted isomerization reaction of linoleic acid to CLA in soy oil in hydrogenation unit. There is an approximately 84 times increase in CLA yield in the presence of both formic acid (1%) and cysteine (0.1%). The unexpectedly superior results indicated that there is a synergistic augmentation effect of formic acid and cysteine with nickel catalyst to the production of CLA-rich oil in hydrogenation unit.

TABLE 6

Effect of formic acid and cysteine on CLA yield in hydrogenation unit processed at 210° C., a pressure of 38 psi and a mixing speed of 800 rpm in the presence of 1% nickel catalyst in sealed system for 2 hrs min.

| Formic acid (%) | Cysteine (%) | Trans-oleic acid (%) | Trans-oleic acid (%) | Total CLA (%) |
|---|---|---|---|---|
| 0 | 0 | 0 | 0 | 0.21 |
| 1 | 0 | 1.9 | 1.9 | 2.4 |
| 1 | 0.1 | 4.1 | 4.1 | 17.6 |

Effect of nickel catalyst dose on CLA yield: RBDSO of 500 g was added into 1 L reactor, 0.25% of formic acid (97%), nickel catalyst with the dose from 0.025% to 2% and the cysteine with the amount of 10% nickel were then added into above 500 g soy oil, respectively. After oxygen was removed with flushing of nitrogen gas, the oil was processed in a sealed system at 210° C., a pressure of 49.2 psi and a mixing speed of 1200 rpm for 2 hrs.

Figure 7:
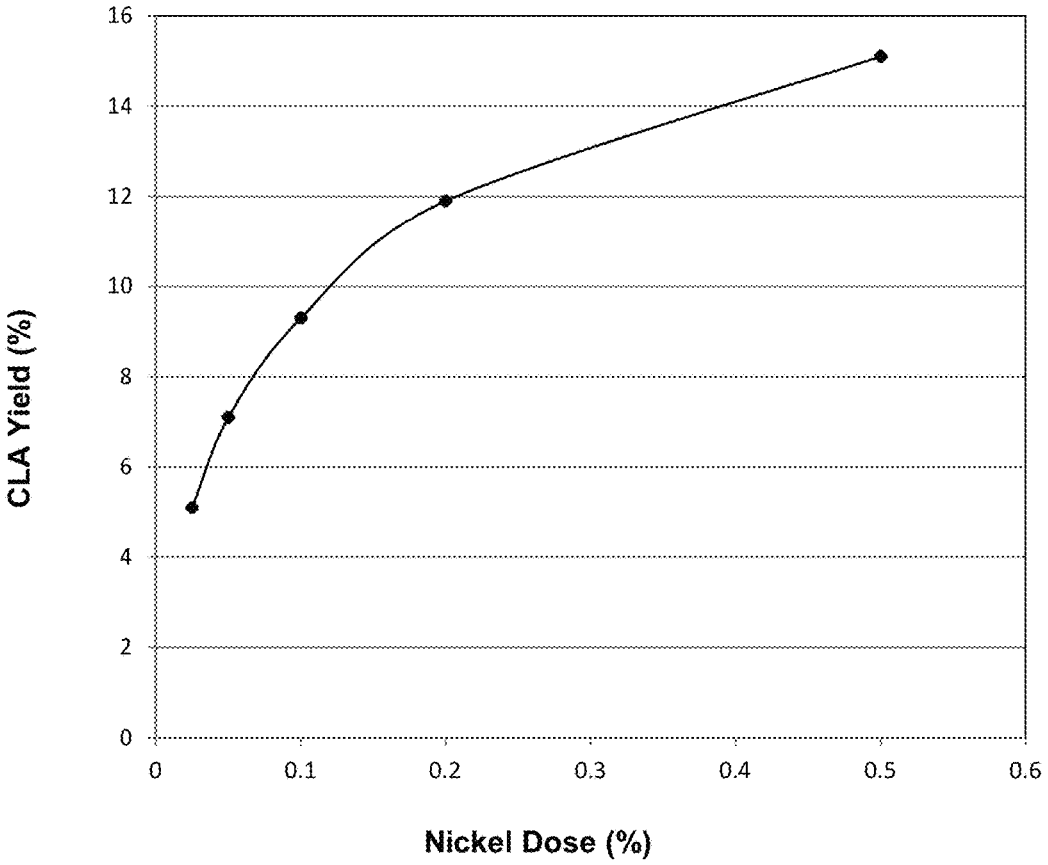
FIG. 7 graphically illustrates the effect of nickel catalyst dose on CLA yield in a hydrogenation unit processed in the presence of 0.25% formic acid and cysteine and of 10% nickel at 210° C., at a pressure of 49.2 psi and mixing speed of 1200 rpm for 2 hrs.

FIG. 7 shows the effect of nickel catalyst dose on CLA yield in hydrogenation unit processed in the presence of 0.25% formic acid and cysteine, of 10% nickel, at 210° C., a pressure of 49.2 psi and mixing speed of 1200 rpm for 2 hrs. By comparing FIG. 7 with FIG. 5, the dose of nickel is considerably lower in the hydrogenation unit than that in the oil deodorizer unit because the pressure can be applied in the pressurized reactor and mixing is more efficient in hydrogenation unit. In the oil deodorizer unit of Examples 1 and 2, a large amount of formic acid is needed to achieve the high CLA yield because formic acid was continually removed from the reactor in a steam stripping conditions with vacuum. In the hydrogenation unit of Example 2, appropriate 5% CLA yield can be obtained with as little as 0.025% of nickel catalyst in 0.25% of formic acid and 0.0025% of cysteine. CLA yield increased with the increase of nickel catalyst, at lower concentration nickel, CLA increased rapidly which is similar with that processed in oil deodorizer.

Table 7 shows the effect of nickel dose on CLA yield and trans-fat at the formic acid of 0.25%, cysteine at the ratio of cysteine to nickel (1:10), 210° C., processing time of 2 hrs, pressure of 40 psi and mixing speed of 1200 rpm.

TABLE 7

Effect of nickel dose on CLA yield and trans-fat at the formic acid of 0.25%, cysteine at the ratio of cysteine to nickel (1:10), 210° C., processing time of 2 hrs, pressure of 40 psi and mixing speed of 1200 rpm.

| Nickel (%) | Trans-oleic acid (%) | Trans CLA (%) | Total CLA (%) |
|---|---|---|---|
| 1 | 6.9 | 9.3 | 23.6 |
| 0.5 | 4.2 | 5.7 | 15.1 |
| 0.25 | 3.0 | 4.1 | 11.7 |
| 0.1 | 0.4 | 1.4 | 4.3 |

Effect of formic acid on CLA yield: RBDSO of 200 g was added into 1 L reactor, 1% nickel catalyst, 0.05% of cysteine by the weight of soy oil, and formic acid with the amount of 0, 0.25%, 0.5%, 1% by the weight of soy oils were then added into above 200 g soy oil, respectively. After oxygen was removed with flushing of nitrogen gas, the oil was processed in a sealed system at 210° C., a pressure of 45 psi and a mixing speed of 800 rpm for 2 hrs.

Table 8 below shows effect on formic acid on CLA yield and trans-oleic acid processed at 1% of nickel, 0.05% cysteine, 210° C., a pressure of 45 psi and mixing speed of 800 rpm for 2 hrs in a sealed system. CLA yield slight increased, however, trans-oleic acid largely increased with increase of formic acid. Therefore, 0.25% formic acid was chosen in optimizing the operational parameters below.

TABLE 8

Effect on formic acid on CLA yield and trans-oleic acid processed at 1% of nickel, 0.05% cysteine, 210° C., a pressure of 45 psi and mixing speed of 800 rpm for 2 hrs in a sealed system.

| Formic acid (%) | Trans-oleic acid (%) | Total CLA (%) | Trans CLA (%) |
|---|---|---|---|
| 0 | 0.7 | 11.1 | 3.7 |
| 0.25 | 6.9 | 23.6 | 9.3 |
| 0.5 | 6.1 | 22.2 | 8.3 |
| 1 | 7.9 | 25 | 9.5 |

Effect of cysteine on CLA yield: RBDSO of 500 g was added into 1 L reactor, 0.5% nickel catalyst, 0.25% of formic acid by the weight of soy oil and cysteine with the amount of 0, 0.005%, 0.01%, 0.025%, 0.05%, 0.1%, 0.2%, 0.4% by the weight of soy oils were then added into above 500 g soy oil, respectively. After oxygen was removed with flushing of nitrogen gas, the oil was processed in a sealed system at 210° C., a pressure of 45 psi and a mixing speed of 1200 rpm for 2 hrs.

Figure 8:
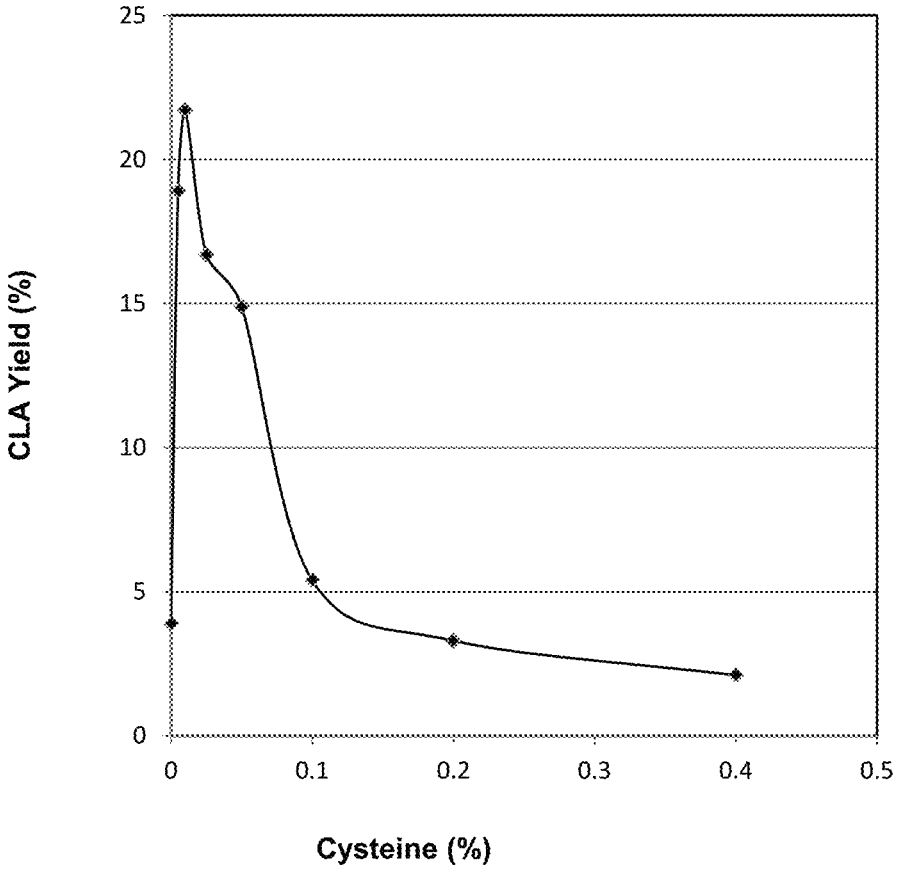
FIG. 8 graphically illustrates the effect of cysteine on CLA yield in a hydrogenation unit processed in the presence of 0.5% nickel and 0.25% formic acid at 210° C., a pressure of 45 psi and mixing speed of 1200 rpm for 2 hrs.

FIG. 8 shows effect of cysteine on effect of CLA yield at 0.5% nickel catalyst and 0.25% formic acid processed at 210° C., a pressure of 45 psi and mixing speed of 1200 rpm for 2 hrs. FIG. 8 indicates that cysteine at the amount of from 1 to 10 percent of metal nickel, specifically 1% of nickel produce unexpectedly high CLA yields.

Tables 9 and 10 below show the effect of cysteine in the presence of nickel (0.05% Pricat 9925 in Table 9, and 0.1% Pricat 9925 in Table 10) on CLA yield with 0.25% formic acid at 210° C., 49.2 psi, mixing rate of 1200 rpm and processing time of 2 hrs.

TABLE 9

Effect of cysteine in the presence of nickel (0.05% 9925) on CLA yield with 0.25% of formic acid at 210° C., 49.2 PSI, mixing rate of 1200 RPM and processing time of 2 hrs

| Cysteine (%) | Ratio to Nickel | Trans oleic acid | Trans CLA (%) | Total CLA (%) |
|---|---|---|---|---|
| 0.01 | 1/5 | 0.41 | 2.1 | 5.9 |
| 0.005 | 1/10 | 0.13 | 2.2 | 7.1 |
| 0.002 | 1/25 | 0 | 1.1 | 4.5 |

TABLE 10

Effect of cysteine in the presence of nickel (0.1% 9925) on CLA yield with 0.25% of formic acid at 210° C., 49.2 psi, mixing rate of 1200 rpm and processing time of 2 hrs.

| Cysteine (%) | Ratio to Nickel | Trans oleic acid | Trans CLA (%) | Total CLA (%) |
|---|---|---|---|---|
| 0.01 | 1/10 | 0.47 | 3.8 | 10.5 |
| 0.005 | 1/20 | 0.33 | 3.5 | 9.3 |
| 0.002 | 1/50 | 0 | 1.7 | 6.2 |

Effect of temperature on CLA yield and trans-oleic acid: RBDSO of 200 g was added into 1 L reactor, 1% nickel catalyst, 0.25% of formic acid, 0.05% of cysteine by the weight of soy oil were then added into above 200 g soy oil. After oxygen was removed with flushing of nitrogen gas, the oil was processed in a sealed system at a pressure of 45 psi, a mixing speed of 800 rpm and the temperature of 165° C., 175° C., and 210° C., respectively for 2 hrs.

Table 11 shows the effect of temperature on the CLA yield at 1% of nickel, 1% formic acid, 0.05% cysteine, processing time of 2 hours, and mixing speed of 800 rpm, indicating that increase processing temperatures results in additional CLA yield.

TABLE 11

Effect of temperature on the CLA yield at 1% of nickel, 1% formic acid, 0.05% cysteine, processing time of 2 hours, and mixing speed of 800 rpm.

| Temperature (° C.) | Trans-oleic acid (%) | Trans CLA (%) | Total CLA (%) |
|---|---|---|---|
| 165 | 2.7 | 0.2 | 3.5 |
| 175 | 4.0 | 4.5 | 12.1 |
| 210 | 7.9 | 9.5 | 25.0 |

Figure 10:
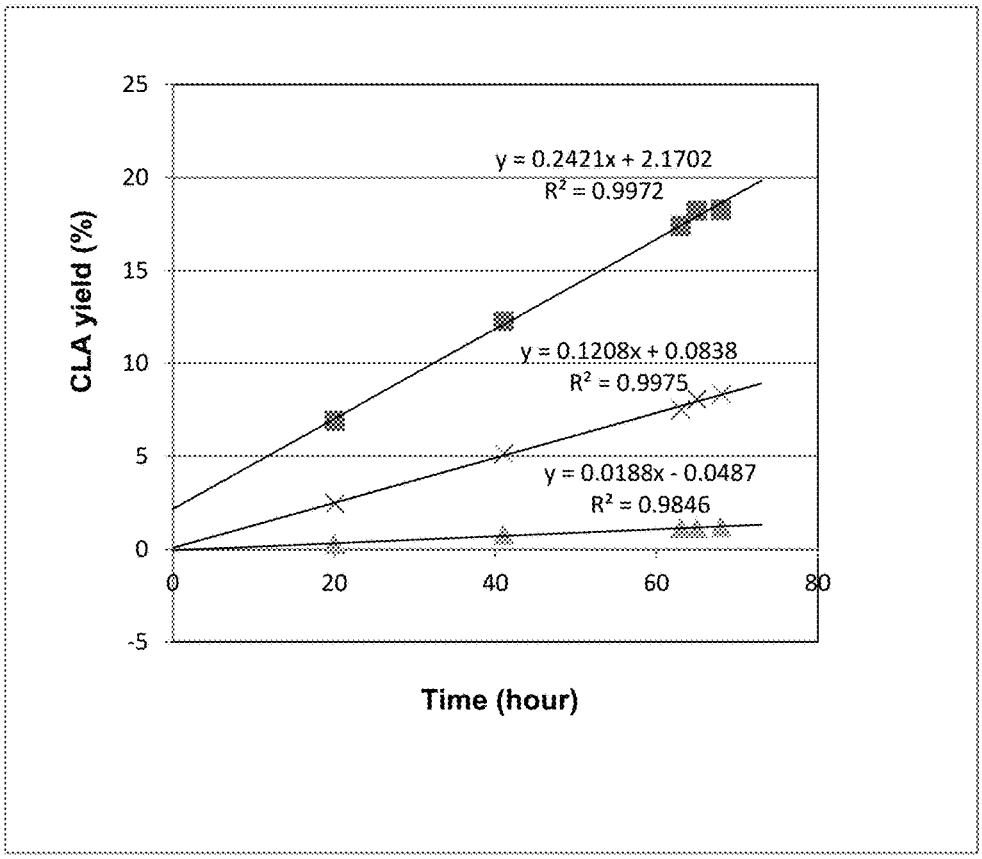
FIG. 10 graphically illustrates the effect of processing temperature on CLA yield and trans-oleic acid processed in the presence of 0.04% nickel (Pricat 9925), 0.25% formic acid, 0.004% cysteine, 175° C., at a pressure of 49.2 psi with flowing nitrogen and at a mixing speed of 900 rpm.

FIG. 10 shows the results of processing temperature on CLA yield and trans-oleic acid processed at 0.04% nickel (Pricat 9925), 0.25% formic acid, 0.004% cysteine, 175° C., a pressure of 49.2 psi with flowing nitrogen at a mixing speed of 900 rpm. As illustrated, at 175° C. using 0.04% Ni, the inventive process can produce almost 20% CLA oil in about 65 hours.

Effect of mixing speed on CLA yield and trans-oleic acid: RBDSO of 500 g was added into 1 L reactor, 0.5% nickel catalyst, 0.25% of formic acid and 0.0025% of cysteine by the weight of soy oil were then added into above 500 g soy oil. After oxygen was removed with flushing of nitrogen gas, the oil was processed in a sealed system at a pressure of 45 psi and the temperature of 210° C. for 2 hrs in different mixing speed from 100 rpm to 1800 rpm.

Table 12 shows effect on mixing on CLA yield processed at 0.5% of nickel, 0.25% formic acid, 0.025% cysteine, 210° C., a pressure of 45 psi and different of mixing speed of from 100 to 1800 rpm for 2 hrs in a sealed system. CLA yield increased while mixing speed increased from 100 rpm to 900 rpm, however, further increased mixing speed up to 1800 rpm CLA yield slightly decreased.

TABLE 12

Effect on mixing on CLA yield processed at 0.5% of nickel, 0.25% formic acid, 0.025% cysteine, 210° C., a pressure of 45 psi and different of mixing speed of from 100 to 1800 rpm for 2 hrs in a sealed system.

| Mixing speed (rpm) | Trans-oleic acid (%) | Trans CLA (%) | Total CLA (%) |
|---|---|---|---|
| 100 | 0.2 | 1.7 | 4.6 |
| 500 | 2.4 ± 2.4 | 6.4 ± 0.2 | 17.9 ± 0.2 |
| 900 | 2.5 ± 2.3 | 6.6 ± 0.7 | 18.3 ± 1.5 |
| 1200 | 2.7 ± 2.7 | 6.3 ± 0.6 | 17.6 ± 1.2 |
| 1500 | 0.6 | 5.1 | 14.5 |
| 1800 | 0.6 | 4.7 | 14.3 |

Effect of type of soy oils on CLA yield and trans-oleic acid: Each of the once-refined oil (OR), refined, bleached (RB) and RBDSO of 500 g was added into 1 L reactor, respectively. 0.2% nickel catalyst (Pricat 9925), 0.25% of formic acid, and 0.004% cysteine by the weight of soy oil were added into the reactor. After oxygen was removed with flushing of nitrogen gas, the oil was processed in a sealed system at a pressure of 30 psi, the temperature of 210° C., mixing speed of 1200 rpm for 2 hrs.

Table 13 shows the effect of the type of soy oil on CLA yield processed at 0.2% nickel, 0.25% formic acid, 0.004% cysteine, 210° C., a pressure of 30 psi, mixing speed of 1200 rpm for 2 hrs in a sealed system. As can be seen from Table 13, there is no statistical difference between RB and RBD oil; however, once refined oil generated lower CLA at the same condition.

TABLE 13

Effect of type of soy oil on CLA yield processed at 0.2% nickel, 0.25% formic acid, 0.004% cysteine, 210° C., a pressure of 30 psi, mixing speed of 1200 rpm for 2 hrs in a sealed system.

| Oil Type | Trans-oleic Acid (%) | Trans CLA (%) | Total CLA (%) |
|---|---|---|---|
| Once Refined Oil | 0.13 ± 0.01 | 2.2 ± 0.3 | 7.4 ± 0.7 |
| RB | 2.4 ± 0.05 | 4.2 ± 0.1 | 12.3 ± 1.4 |
| RBD | 2.2 ± 0.04 | 3.6 ± 0.2 | 11.9 ± 0.6 |

Effect of processing time on CLA yield and trans-oleic acid: RBDSO of 700 g was added into 1 L reactor, 0.025% nickel catalyst (Pricat 9925), 0.25% of formic acid, and 0.0025% were added into the reactor containing 700 g RB soy oil. After oxygen was removed with flushing of nitrogen gas, the oil was processed at 210° C., a pressure of 49.2 psi with a constant bleeding of nitrogen and a mixing speed of 1200 rpm for the time from 0 to 8 hrs.

Figure 9:
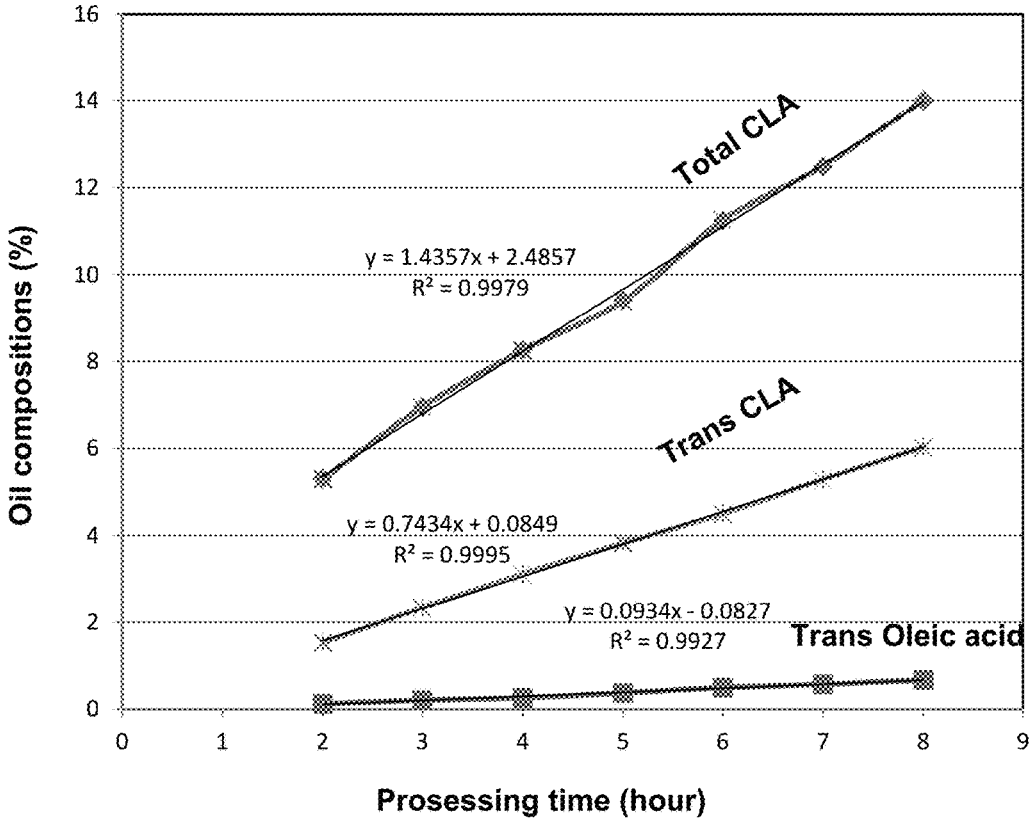
FIG. 9 graphically illustrates the effect of processing time on CLA yield and trans-oleic acid processed in the presence of 0.025% nickel, 0.25% formic acid, 0.0025% cysteine, 210° C., at a pressure of 49.2 psi, mixing speed of 1200 rpm for 2 hrs with bleeding of nitrogen.

FIG. 9 shows the results of processing time on CLA yield and trans-oleic acid processed at 0.025% nickel, 0.25% formic acid, 0.0025% cysteine, 210° C., a pressure of 49.2 psi, mixing speed of 1200 rpm for 2 hrs with bleeding of nitrogen. As illustrated, CLA yield, trans-CLA and trans-oleic acid linearly increased with increase of processing time.

Table 14 shows the effect of processing time on CLA yield at 0.1% of nickel, 0.5% of isopropyl alcohol, 0.02% cysteine, 210° C., pressure of 20 psi and mixing speed of 1200 rpm.

TABLE 14

Effect of processing time on CLA yield at 0.1% of nickel, 0.5% of isopropyl alcohol, 0.02% cysteine, 210° C., pressure of 20 psi and mixing speed of 1200 rpm.

| Time (min) | Trans-oleic acid (%) | Trans CLA (%) | Total CLA (%) |
|---|---|---|---|
| 60 | 0 | 0 | 0.146 |
| 120 | 0 | 0 | 0.148 |
| 180 | 0 | 0.2 | 1.1 |
| 240 | 0 | 0.4 | 1.9 |
| 300 | 0.4 | | 2.9 |
| 360 | 0.6 | 1.3 | 4.1 |

Optimization of CLA Production with Minimal Trans-Fat Formation: Studies were conducted to statistically model CLA-rich oil production to maximize CLA production while minimizing trans-fat formation in order to produce CLA-rich vegetable oil with no or low trans-fat. The inventive heterogeneous catalysis process used catalyst promoted compounds under nitrogen pressure to enhance the catalytic conversion rate from linoleic acid to CLAs in vegetable oils. As with prior experiments, the predetermined amounts of nickel catalyst (Alfa Aesar, Pricat 9925 or Pricat 9910), formic acid, and cysteine were added into a reactor containing RBDSO. After oxygen was removed with flushing of nitrogen gas, the oil was processed at predetermined times, temperatures and pressures with a constant bleeding of nitrogen and a mixing speed of 900 rpm. After reaction completed, the oil with catalyst was poured into a filter container with vacuum to filter the oil and remove the catalyst. The oil was then deodorized.

Table 15 below demonstrates the synergistic effect of nickel catalyst, formic acid and cysteine on the production of CLA. Table 15 also illustrates the effects on the yield of CLA yield and trans-oleic acid by varying the dosing concentrations of nickel catalyst, cysteine and formic acid and by varying the operational parameters of temperature, processing time, pressure and types of catalyst materials. The unexpectedly superior results clearly demonstrate the synergistic augmentation effect of formic acid and cysteine with nickel catalyst to the production of CLA-rich oil.

TABLE 15

Maximizing CLA production and minimizing trans-fat formation at a mixing speed of 900 rpm and under nitrogen pressure.

| Dose of Ni (%) | Dose of cysteine (%) | Dose of formic acid (%) | Temp. (° C.) | Pressure (PSI) | Processing time (Hours) | Total Trans-fat (%) | Total CLA (%) | Comments |
|---|---|---|---|---|---|---|---|---|
| 1 | 0.05 | 1 | 210 | 35 | 2 | 8.2 | 8.1 | Alfa |
| 1 | 0 | 0 | 210 | 25 | 2 | 0.9 | 0.3 | Alfa |
| 1 | 0 | 1 | 210 | 35 | 1 | 2.6 | 2.1 | Alfa |
| 1 | 0.09 | 1 | 210 | 35 | 2 | 9.4 | 17.6 | Alfa |
| 3.3 | 0.25 | 2 | 210 | 35 | 2 | 19.7 | 26.5 | Alfa |
| 3.3 | 0.25 | 1 | 210 | 76 | 2 | 18.5 | 27.4 | Alfa |
| 1 | 0.1 | 1 | 210 | 50 | 2 | 17.1 | 24.7 | Alfa |
| 1 | 0.05 | 1 | 210 | 50 | 2 | 14.5 | 25 | Alfa |
| 1 | 0.1 | 0 | 210 | 22 | 2 | 6.9 | 11.1 | Alfa |
| 1 | 0.05 | 1 | 175 | 49 | 2 | 10.5 | 12.1 | Alfa |
| 1 | 0.05 | 0.5 | 210 | 45 | 2 | 13 | 22.2 | Alfa |
| 1 | 0.05 | 0.25 | 210 | 32 | 2 | 11.1 | 23.6 | Alfa |
| 1 | 0.05 | 1 | 165 | 35 | 2 | 7.2 | 3.5 | Alfa |
| 0.5 | 0.05 | 0.25 | 210 | 40 | 2 | 12 | 15.1 | Alfa |
| 0.1 | 0.02 | 0.25 | 210 | 23 | 2 | 6.1 | 4.3 | Alfa |
| 0.25 | 0.025 | 0.25 | 210 | 45 | 2 | 10.7 | 11.7 | Alfa |
| 0.5 | 0.05 | 0.25 | 210 | 45 | 2 | 6.9 | 5.4 | Alfa |
| 0.5 | 0.05 | 0.25 | 210 | 45 | 3 | 8.5 | 9.5 | Alfa |
| 0.5 | 0.05 | 0.25 | 210 | 45 | 4 | 10.2 | 12.6 | Alfa |
| 0.5 | 0.05 | 0.25 | 210 | 45 | 5 | 11.1 | 15.6 | Alfa |
| 0.5 | 0.2 | 0.25 | 210 | 45 | 2 | 5.6 | 2.1 | Alfa |
| 0.5 | 0.4 | 0.25 | 210 | 68 | 2 | 8.5 | 3.3 | Alfa |
| 0.5 | 0.1 | 0 | 210 | 49 | 2 | 2.4 | 0.7 | Alfa |
| 0.5 | 0.1 | 0 | 210 | 49 | 3 | 3.5 | 1.6 | Alfa |
| 0.5 | 0.1 | 0 | 210 | 49 | 4 | 6 | 3.9 | Alfa |
| 0.5 | 0.1 | 0 | 210 | 49 | 5 | 9.9 | 6.1 | Alfa |
| 0.5 | 0.1 | 0 | 210 | 49 | 6 | 11.9 | 7.9 | Alfa |
| 0.5 | 0.01 | 0.25 | 210 | 49 | 2 | 13.2 | 21.7 | Alfa |
| 0.5 | 0.005 | 0.25 | 210 | 49 | 2 | 9.2 | 18.9 | Alfa |
| 0.5 | 0 | 0.25 | 210 | 49 | 2 | 3 | 3.9 | Alfa |
| 0.2 | 0.004 | 0.25 | 210 | 49 | 2 | 8.1 | 11.7 | Alfa |
| 0.2 | 0.004 | 0.25 | 210 | 49 | 3 | 8 | 16.6 | Alfa |
| 0.2 | 0.004 | 0.25 | 210 | 49 | 4 | S.9 | 18.3 | Alfa |
| 0.2 | 0.004 | 0.25 | 210 | 49 | 5 | 9.8 | 19.8 | Alfa |
| 0.2 | 0.004 | 0.25 | 210 | 50 | 1 | 6 | S.3 | Alfa |
| 0.2 | 0.004 | 0.25 | 210 | 50 | 2 | 7.3 | 13.3 | Alfa |
| 0.2 | 0.004 | 0.25 | 210 | 50 | 3 | 8.8 | 16.3 | Alfa |
| 0.2 | 0.004 | 0.25 | 210 | 50 | 4 | 11.2 | 10 | Alfa |
| 0.2 | 0.004 | 0.25 | 210 | 50 | 5 | 10.5 | 20 | Alfa |
| 0.2 | 0.004 | 0.25 | 210 | 50 | 6 | 11.2 | 21 | Alfa |
| 0.2 | 0.01 | 0.25 | 210 | 50 | 2 | 5.9 | 11.4 | 9925 |
| 0.2 | 0.01 | 0.25 | 210 | 50 | 3 | 6.7 | 13.7 | 9925 |
| 0.2 | 0.01 | 0.25 | 210 | 50 | 4 | 7.3 | 17.9 | 9925 |
| 0.2 | 0.01 | 0.25 | 210 | 50 | 5 | 7.S | 20.2 | 9925 |
| 0.2 | 0.01 | 0.25 | 210 | 50 | 6 | 8.2 | 21.8 | 9925 |
| 0.1 | 0.005 | 0.25 | 210 | 50 | 2 | 6.1 | 9.3 | 9925 |
| 0.1 | 0.005 | 0.25 | 210 | 50 | 3 | 7.3 | 11.1 | 9925 |
| 0.1 | 0.005 | 0.25 | 210 | 50 | 4 | 8.4 | 14 | 9925 |
| 0.1 | 0.005 | 0.25 | 210 | 50 | 5 | 8.8 | 15.7 | 9925 |
| 0.1 | 0.005 | 0.25 | 210 | 50 | 6 | 9.3 | 18.5 | 9925 |
| 0.2 | 0.01 | 0.25 | 210 | 50 | 2 | 5.7 | 11.9 | 9910 |
| 0.2 | 0.01 | 0.25 | 210 | 50 | 3 | 6.2 | 13.6 | 9910 |
| 0.2 | 0.01 | 0.25 | 210 | 50 | 4 | 7 | 14.1 | 9910 |
| 0.2 | 0.01 | 0.25 | 210 | 50 | 5 | 7.6 | 15.2 | 9910 |
| 0.2 | 0.01 | 0.25 | 210 | 50 | 6 | 10.1 | 19.7 | 9910 |
| 0.1 | 0.005 | 0.25 | 210 | 50 | 2 | 6.4 | 9.8 | 9910 |
| 0.1 | 0.005 | 0.25 | 210 | 50 | 3 | 7.4 | 12.9 | 9910 |
| 0.1 | 0.005 | 0.25 | 210 | 50 | 4 | 8.1 | 13.2 | 9910 |
| 0.1 | 0.005 | 0.25 | 210 | 50 | 5 | 8.6 | 17.2 | 9910 |
| 0.1 | 0.005 | 0.25 | 210 | 50 | 6 | 11.9 | 18.4 | 9910 |
| 0.1 | 0.002 | 0.25 | 210 | 50 | 2 | 3.1 | 6.2 | 9925 |
| 0.1 | 0.002 | 0.25 | 210 | 50 | 3 | 3.9 | 7.8 | 9925 |
| 0.1 | 0.002 | 0.25 | 210 | 50 | 4 | 4.4 | 8.9 | 9925 |
| 0.1 | 0.002 | 0.25 | 210 | 50 | 5 | 5 | 9.9 | 9925 |
| 0.1 | 0.002 | 0.25 | 210 | 50 | 6 | 5.4 | 11 | 9925 |
| 0.1 | 0.01 | 0.25 | 210 | 50 | 2 | 8 | 10.5 | 9925 |
| 0.1 | 0.01 | 0.25 | 210 | 50 | 3 | 9.3 | 11.3 | 9925 |
| 0.1 | 0.01 | 0.25 | 210 | 50 | 5 | 11.4 | 17.5 | 9925 |
| 0.1 | 0.01 | 0.25 | 210 | 50 | 6 | 12.6 | 19.1 | 9925 |
| 0.05 | 0.005 | 0.25 | 210 | 50 | 2 | 5.7 | 6.8 | 9925 |
| 0.05 | 0.005 | 0.25 | 210 | 50 | 3 | 8 | 8.9 | 9925 |
| 0.05 | 0.005 | 0.25 | 210 | 50 | 4 | 9.3 | 12.1 | 9925 |
| 0.05 | 0.005 | 0.25 | 210 | 50 | 5 | 10.3 | 12.2 | 9925 |

TABLE 15-continued

Maximizing CLA production and minimizing trans-fat formation at a mixing speed of 900 rpm and under nitrogen pressure.

| Dose of Ni (%) | Dose of cysteine (%) | Dose of formic acid (%) | Temp. (° C.) | Pressure (PSI) | Processing time (Hours) | Total Trans-fat (%) | Total CLA (%) | Comments |
|---|---|---|---|---|---|---|---|---|
| 0.05 | 0.005 | 0.25 | 210 | 50 | 6 | 10.0 | 15.9 | 9925 |
| 0.05 | 0.005 | 0.25 | 210 | 50 | 7 | 11.7 | 17 | 9925 |
| 0.025 | 0.0025 | 0.25 | 210 | 50 | 2 | 3.9 | 4.6 | 9925 |
| 0.025 | 0.0025 | 0.25 | 210 | 50 | 3 | 5.1 | 0.2 | 9925 |
| 0.025 | 0.0025 | 0.25 | 210 | 50 | 4 | 6.4 | 7.4 | 9925 |
| 0.025 | 0.0025 | 0.25 | 210 | 50 | 5 | 7.6 | 8.3 | 9925 |
| 0.025 | 0.0025 | 0.25 | 210 | 50 | 6 | 8.3 | 10.6 | 9925 |
| 0.025 | 0.0025 | 0.25 | 210 | 50 | 2 | 4.2 | 6 | 9925 |
| 0.025 | 0.0025 | 0.25 | 210 | 50 | 3 | 5.1 | 7.6 | 9925 |
| 0.025 | 0.0025 | 0.25 | 210 | 50 | 4 | 6.3 | 9.1 | 9925 |
| 0.025 | 0.0025 | 0.25 | 210 | 50 | 5 | 7.1 | 10.5 | 9925 |
| 0.025 | 0.0025 | 0.25 | 210 | 50 | 6 | 7.3 | 11.9 | 9925 |
| 0.05 | 0.005 | 0.1 | 210 | 50 | 2 | 7.4 | 6.5 | 9925 |
| 0.05 | 0.005 | 0.1 | 210 | 50 | 3 | 8.4 | 7.6 | 9925 |
| 0.05 | 0.005 | 0.1 | 210 | 50 | 4 | 10.2 | 10.3 | 9925 |
| 0.05 | 0.005 | 0.1 | 210 | 50 | 5 | 11.3 | 11.7 | 9925 |
| 0.05 | 0.005 | 0.1 | 210 | 50 | 6 | 12.1 | 13.6 | 9925 |
| 0.05 | 0.005 | 0.05 | 210 | 50 | 2 | 6.9 | 5.4 | 9925 |
| 0.05 | 0.005 | 0.05 | 210 | 50 | 3 | 8.4 | 6.3 | 9925 |
| 0.05 | 0.005 | 0.05 | 210 | 50 | 4 | 9.5 | 7.2 | 9925 |
| 0.05 | 0.005 | 0.05 | 210 | 50 | 5 | 10.7 | 8.6 | 9925 |
| 0.05 | 0.005 | 0.05 | 210 | 50 | 6 | 11.5 | 10.8 | 9925 |
| 0.025 | 0.0025 | 0.25 | 210 | 50 | 2 | 4.8 | 4.1 | 9925 |
| 0.025 | 0.0025 | 0.25 | 210 | 50 | 3 | 5.8 | 4.2 | 9925 |
| 0.025 | 0.0025 | 0.25 | 210 | 50 | 4 | 7 | 5.3 | 9925 |
| 0.025 | 0.0025 | 0.25 | 210 | 50 | 5 | 7.6 | 5.9 | 9925 |
| 0.025 | 0.0025 | 0.25 | 210 | 50 | 6 | 8.9 | 7 | 9925 |
| 0.025 | 0.0025 | 0.25 | 210 | 50 | 7 | 9.9 | 7.9 | 9925 |
| 0.025 | 0.0025 | 0.25 | 210 | 50 | 8 | 10.4 | 9.8 | 9925 |
| 0.025 | 0.0025 | 0.25 | 230 | 50 | 2 | 9.5 | 8.7 | 9925 |
| 0.025 | 0.0025 | 0.25 | 230 | 50 | 2 | 0.0 | 11.2 | 9925 |
| 0.04 | 0.004 | 0.25 | 210 | 50 | 2 | 6.5 | 5.8 | 9925 |
| 0.04 | 0.004 | 0.25 | 210 | 50 | 3 | 7.9 | 6.9 | 9925 |
| 0.04 | 0.004 | 0.25 | 210 | 50 | 4 | 8.8 | 8.4 | 9925 |
| 0.04 | 0.004 | 0.25 | 210 | 50 | 5 | 10.4 | 11.1 | 9925 |
| 0.04 | 0.004 | 0.25 | 210 | 50 | 6 | 11.4 | 12.1 | 9925 |
| 0.04 | 0.004 | 0.25 | 210 | 50 | 7 | 12.1 | 13.3 | 9925 |
| 0.04 | 0.004 | 0.25 | 175 | 50 | 20 | 6.5 | 6.9 | 9925 |
| 0.04 | 0.004 | 0.25 | 175 | 50 | 41 | 10 | 12.3 | 9925 |
| 0.04 | 0.004 | 0.25 | 175 | 50 | 63 | 11.5 | 17.4 | 9925 |
| 0.04 | 0.004 | 0.25 | 175 | 50 | 65 | 11.8 | 18.2 | 9925 |
| 0.04 | 0.004 | 0.25 | 175 | 50 | 68 | 12.1 | 18.2 | 9925 |
| 0.04 | 0.004 | 0.25 | 175 | 50 | 48 | 10.8 | 11.1 | 9925 |
| 0.4 | 0.04 | 0.25 | 175 | 50 | 6 | 4.1 | 6.3 | 9925 |
| 0.4 | 0.02 | 0.25 | 240 | 50 | 3 | 21.9 | 23.3 | 9925 |
| 0.4 | 0.04 | 0.25 | 155 | 50 | 15 | 2.3 | 3.2 | 9925 |
| 1 | 0.1 | 0.25 | 135 | 50 | 24 | 0.7 | 0.3 | 9925 |

Whereas, the processes and systems have been described in relation to the drawings and claims, it should be understood that other and further modifications, apart from those shown or suggested herein, may be made within the scope of this invention.

What is claimed is:

1. A process for producing conjugated linoleic acid-rich oil, said process comprising the steps of:

heterogeneously catalyzing a linoleic acid-rich oil using a catalytic amount of nickel in the presence of a promoter to produce said conjugated linoleic acid-rich oil.

2. The process of claim 1 wherein said linoleic acid-rich oil is a triacylglyceride vegetable oil.

3. The process of claim 2 wherein said triacylglyceride vegetable oil is selected from the group consisting of soy, sunflower, corn, cottonseed and peanut oil.

4. The process of claim 1 wherein said nickel is metal nickel, nickel sulfide (NiS) or nickel formate $Ni(COO)_2$.

5. The process of claim 4 wherein said metal nickel is distributed on silica/alumina, nickel alloys with iron, aluminum, chromium and carbon loaded on silica/alumina.

6. The process of claim 1 wherein said nickel is an organic amino or thiol compound self-assembly monolayer modified nickel catalyst.

7. The process of claim 1 wherein said catalytic amount of said nickel comprises up to about 10% nickel.

8. The process of claim 7 wherein said catalytic amount of said nickel comprises between about 0.025% and about 1% nickel.

9. The process of claim 1 wherein said promoter is selected from the group consisting of organic proton donors, monosulfides, disulfides, mercaptans and mixtures thereof.

10. The process of claim 9 wherein said promoter is selected from the group consisting of methanol, ethanol, isopropyl alcohol, formic acid, acetic acid, benzoic acid, 2-mercaptoethanol, ethanethiol, 1,2-ethanedithiol, L-cysteine, cysteamine, thiolactic acid, mercaptosuccinic acid and a mixture thereof.

11. The process of claim 10 wherein said promoter is selected from the group consisting of acetic acid, formic acid, L-cysteine, mercaptosuccinic acid and a mixture thereof.

12. The process of claim 1 wherein said promoter is formic acid, L-cysteine or a mixture thereof.

13. The process of claim 12 wherein said formic acid comprises up to about 10% formic acid in said linoleic acid-rich oil and about 85% formic acid as a steam.

14. The process of claim 13 wherein said formic acid in said linoleic acid-rich oil comprises between about 0.05% and about 2% formic acid in said linoleic acid-rich oil.

15. The process of claim 12 wherein said cysteine comprises up to about 1% cysteine.

16. The process of claim 15 wherein said cysteine comprises between about 0.002% and about 0.4% cysteine.

17. The process of claim 12 wherein said mixture of formic acid and cysteine comprises a cysteine-to-nickel ratio of about 1:10.

18. The process of claim 1 said catalysis step further comprises catalyzing said linoleic acid-rich oil using said catalytic amount of said nickel in the presence of cysteine, formic acid or a mixture thereof to produce said conjugated linoleic acid-rich oil.

19. The process of claim 18 wherein said catalysis step further comprises catalyzing said linoleic acid-rich oil using said catalytic amount of said nickel in the presence of said cysteine, formic acid or a mixture thereof at a temperature of between about 165° C. and about 250° C. to produce said conjugated linoleic acid-rich oil.

20. The process of claim 18 wherein said catalysis step further catalyzing said linoleic acid-rich oil using said catalytic amount of said nickel in the presence of said cysteine, forming acid or a mixture thereof under nitrogen pressure with bleeding of said nitrogen to produce said conjugated linoleic acid-rich oil.

21. The process of claim 20 wherein said catalysis step further comprises catalyzing said linoleic acid-rich oil using said catalytic amount of said nickel in the presence of said cysteine, formic acid or a mixture thereof under nitrogen pressure of up to about 76 psi to produce said conjugated linoleic acid-rich oil.

22. The process of claim 21 wherein said nitrogen pressure is between about 40 psi and about 50 psi.

23. The process of claim 18 wherein said catalysis step further comprises catalyzing said linoleic acid-rich oil using said catalytic amount of said nickel in the presence of said cysteine, formic acid or a mixture thereof for between about 30 minutes and about 68 hours to produce said conjugated linoleic acid-rich oil.

24. The process of claim 23 wherein said catalysis step further comprises catalyzing said linoleic acid-rich oil using said catalytic amount of said nickel in the presence of said cysteine, formic acid or a mixture thereof for between about 30 minutes and about 6 hours to produce said conjugated linoleic acid-rich oil.

25. The process of claim 20 wherein said catalysis step further comprises catalyzing said linoleic acid-rich oil using said catalytic amount of said nickel in the presence of said cysteine, formic acid or a mixture thereof under nitrogen pressure between about 40 psi and about 50 psi for between about 30 minutes and about 6 hours at temperature of about 210° C. to produce said conjugated linoleic acid-rich oil.

26. The process of claim 25 wherein said nickel comprises between about 0.04% and about 1% nickel.

27. The process of claim 26 wherein said cysteine, formic acid or a mixture thereof comprises between about 0.004% and about 0.25% cysteine and between about 0.25% and about 1% formic acid.

28. The process of claim 26 wherein said cysteine, formic acid or a mixture thereof comprises about 10% formic acid in said linoleic acid-rich oil and about 85% formic acid as a steam.

29. The process of claim 1 wherein said catalysis step further comprises catalyzing said linoleic acid-rich oil using said nickel in the presence of said promoter using steam/vacuum distillation to produce said conjugated linoleic acid-rich oil.

30. The process of claim 1 wherein said catalysis step further comprises catalyzing said linoleic acid-rich oil using said nickel in the presence of said promoter using oil deodorization to produce said conjugated linoleic acid-rich oil.

31. The process of claim 1 wherein said catalysis step further comprises catalyzing said linoleic acid-rich oil using said nickel in the presence of said promoter using hydrogenation to produce said conjugated linoleic acid-rich oil.

32. The process of claim 1 further comprising the step of extracting any remaining nickel residue from said conjugated linoleic acid-rich soil.

33. The process of claim 32 wherein said extraction step further comprises extracting said transition metal residue from said conjugated linoleic acid-rich soil using filtration, bleaching, deodorization, adsorbents, centrifugation or a combination thereof.

34. The process of claim 1 further comprising the step of recovering said promoter from a steam condensate during said catalysis step.

35. The process of claim 19 wherein said temperature is about 210° C.

* * * * *